US006764082B2

(12) United States Patent
Roderick

(10) Patent No.: US 6,764,082 B2
(45) Date of Patent: Jul. 20, 2004

(54) SHOES FOR WALKING AND ROLLING

(75) Inventor: John A. Roderick, Scituate, RI (US)

(73) Assignee: Mearthane Products Corporation, Cranston, RI (US)

( * ) Notice: Subject to any disclaimer, the term of this patent is extended or adjusted under 35 U.S.C. 154(b) by 0 days.

(21) Appl. No.: 10/081,388

(22) Filed: Feb. 20, 2002

(65) Prior Publication Data

US 2003/0155725 A1 Aug. 21, 2003

(51) Int. Cl.[7] ..... A63C 17/04
(52) U.S. Cl. ..... 280/11.223; 280/11.19; 280/7.13
(58) Field of Search ..... 280/11.19, 7.13, 280/11.223, 11.225, 11.226, 11.227, 11.232, 11.26, 11.28, 11.27, 843; 36/115, 116, 132, 136, 75; 301/5.3; A63C 17/04

(56) References Cited

U.S. PATENT DOCUMENTS

| | | | | | |
|---|---|---|---|---|---|
| 862,431 | A | * | 8/1907 | Armband | 280/843 |
| 1,271,891 | A | * | 7/1918 | Gustin | 280/843 |
| 1,984,989 | A | * | 12/1934 | Reed | 36/8.3 |
| 2,095,942 | A | * | 10/1937 | Weeterstrand | 280/7.13 |
| 2,165,581 | A | * | 7/1939 | Schroeder | 280/11.209 |
| 3,306,623 | A | * | 2/1967 | Weitzner | 280/11.206 |
| 3,351,353 | A | * | 11/1967 | Weitzner | 280/7.13 |
| 3,522,951 | A | * | 8/1970 | Tyson | 280/842 |
| 3,871,672 | A | | 3/1975 | Bardy | |
| 3,884,485 | A | | 5/1975 | Wälle | |
| 3,963,251 | A | * | 6/1976 | Miano | 280/843 |
| 3,979,842 | A | | 9/1976 | Texidor | |
| 3,983,643 | A | | 10/1976 | Schreyer et al. | |
| 4,305,598 | A | * | 12/1981 | Brandner | 280/11.209 |
| 4,333,249 | A | | 6/1982 | Schaefer | |
| 4,618,158 | A | * | 10/1986 | Liberkowski | 280/843 |
| 4,691,453 | A | * | 9/1987 | Tifre | 36/8.3 |
| 4,744,576 | A | * | 5/1988 | Scollan, Jr. | 280/87.042 |
| 4,928,982 | A | | 5/1990 | Logan | |
| 5,199,727 | A | * | 4/1993 | Lai | 280/11.28 |
| 5,249,376 | A | * | 10/1993 | Capria | 36/115 |
| 5,398,970 | A | | 3/1995 | Tucky | |
| 5,443,277 | A | * | 8/1995 | Kubierschky | 280/11.223 |
| D373,674 | S | * | 9/1996 | Dolinsky | D2/956 |
| 5,566,958 | A | * | 10/1996 | Sinelnikov et al. | 280/11.231 |
| 5,716,074 | A | * | 2/1998 | Theodorou | 280/843 |
| 5,765,870 | A | | 6/1998 | Riley | |

(List continued on next page.)

FOREIGN PATENT DOCUMENTS

| | | |
|---|---|---|
| CN | 88103805 A | 12/1988 |
| DE | 20009641 U1 | 9/2000 |
| WO | WO 00/16862 | 3/2000 |
| WO | WO 00/59323 | 10/2000 |

OTHER PUBLICATIONS

Muzslay, "Shoes That Morph From Sneakers to Skates Are Flying Out of Stores", *The Wall Street Journal,* p. B1, Jul. 26, 2001.

Tanner, "Shoe–skate seeks to steal spotlight", *Dallas Business Journal,* Jan. 19, 2001.

*Primary Examiner*—Bryan Fischmann
*Assistant Examiner*—Kelly E. Campbell
(74) *Attorney, Agent, or Firm*—Fish & Richardson P.C.

(57) ABSTRACT

Shoes with various configurations of rollers secured to one region of their soles for rolling, while leaving another sole region exposed for walking. The rollers are mounted to rotate about an axle defining a primary axis of rotation extending at an angle of between about zero and 45 degrees to the walking direction, as viewed from above the shoe, for rolling sideways along a support surface. This provides a combined running-rolling method of locomotion, by running on the exposed sole surfaces, and then jumping into a "surfing" stance for rolling. In some cases, the rollers are mounted on steerable truck assemblies. One particularly small truck assembly includes wedge-shaped bushings for steering compliance.

133 Claims, 20 Drawing Sheets

U.S. PATENT DOCUMENTS 5,772,220 A 6/1998 Gaster
5,785,327 A 7/1998 Gallant
5,797,609 A 8/1998 Fichepain
5,806,860 A * 9/1998 Conte ..... 280/11.231
5,836,591 A * 11/1998 Roderick et al. ..... 280/11.233
5,947,486 A * 9/1999 Zell ..... 280/11.201
5,967,552 A * 10/1999 Roderick et al. ..... 280/843
6,120,039 A 9/2000 Clementi
D433,214 S * 11/2000 McDowell ..... D2/957
6,158,150 A * 12/2000 Morris et al. ..... 36/115
6,195,918 B1 * 3/2001 Kelley et al. ..... 36/115
6,227,622 B1 5/2001 Roderick et al.
6,247,708 B1 * 6/2001 Hsu ..... 280/11.223
6,406,038 B2 * 6/2002 Adams ..... 280/11.24
6,412,791 B1 * 7/2002 Chu ..... 280/11.19
6,450,509 B2 * 9/2002 Adams ..... 280/11.24

* cited by examiner

SHOES FOR WALKING AND ROLLING

TECHNICAL FIELD

This invention relates to shoes adapted for both walking and rolling.

BACKGROUND

There have been several proposals over the last century, and earlier, for walking shoes that can be readily converted to function temporarily as roller skates. A principal advantage to such shoes is the enhanced flexibility in transportation modes that they afford. Most are familiar with the rigid skate frames from several years ago that strapped to the underside of practically any normal walking shoe to permit the wearer to roll upon four wheels arranged two forward, two rear, in a forward or normal walking direction as in a standard roller skate. There is at least one walking shoe on the market that contains wheels that can be retracted into the sole of the shoe for walking, and then extended for rolling. Of course, such shoes require soles with thicknesses sufficient to fully contain such rollers when retracted, but have the advantage of not requiring their rolling parts to be carried separately while walking.

In a rolling mode with these and standard roller skates, the wearer generally is able to propel himself along with alternating forward thrusts with each foot, in a motion similar to ice skating. The direction of travel is generally determined by the fore-aft or toe-heel axis of the foot. In-line skates have their wheels aligned along the fore-aft center line of the shoe, and can provide some directional control by tilting the skate to change the camber of the wheels. Some in-line skates have been employed for sliding down railings in a direction perpendicular to the fore-aft shoe centerline, either by sliding down the railing with the railing positioned between a middle pair of rollers, or on skid plates between the wheels.

There is another shoe that has a removable roller mounted in a cavity the heel of the sole. For walking, the roller can be completely removed from its cavity. In a rolling mode, the wearer can, with practice and balance, roll in a forward direction upon the cylindrical roller with ankle locked and shin flexed. To obtain forward momentum, the wearer is instructed to run on the forward portions of the soles, and then lean back to engage only the heel rollers of both shoes with the ground for sustained rolling in the fore-aft direction as determined by the roller geometry and orientation.

Skateboarding is yet another mode of transportation and sport popular with young people. Skateboards are generally characterized as boards supported by forward and rear "trucks," each having a pair of wheels mounted upon a tiltable axle. While rolling forward on the board, side-to-side weight fluctuations tilt the board and cause a shift in the rolling direction of the wheels to provide controllable steering of the board. The rolling direction is thus determined by the orientation of the wheel axles, although the normal rolling direction is along a major fore-aft axis of the board. It is common for the skateboarder to place her feet at an angle with respect major board axis, with one foot behind the other, similar to the stance of a surfer on a surfboard.

SUMMARY

I have realized that a generally enjoyable and stable transportation mode is effected with a convertible shoe that enables rolling along a direction other than the walking direction determined by the fore-aft shoe centerline, and by new and improved rolling shoe and truck assembly constructions.

According to one aspect of the invention, a shoe defines a normal walking direction and has a sole defining a forward region positioned beneath toes and at least part of a ball of a foot received within the shoe. The sole has a lower surface exposed across the forward region to engage a supporting surface for walking thereon. The shoe also has a roller secured to the sole and disposed rearward of the forward region. The roller is mounted to rotate about an axle defining a primary axis of rotation extending at an angle of between about zero and 45 degrees to the walking direction, as viewed from above the shoe, for rolling sideways along a support surface.

By "normal walking direction" I mean the direction generally defined by a fore-aft or toe-heel axis running along the length of the shoe.

Preferably, the roller is either removable or retractable, and the sole is sufficiently flexible to comfortably bend during walking.

In many instances, the roller forms a lowermost portion of the shoe.

In some embodiments, the axle is mountable to the sole in a plurality of selectable axis orientations. In some cases the axle defines, in one such orientation, an alternate axis of rotation extending substantially perpendicular to the walking direction.

Some shoes include two such rollers, which may be spaced apart laterally across the sole. Preferably, centers of the two rollers have a lateral spacing of about 20 percent of an overall length of the sole. In some instances, the rollers are spaced apart along the walking direction, with midplanes of the two rollers preferably spaced apart along the walking direction by a distance of about 30 percent of an overall length of the sole.

In some embodiments, the shoe also has a grinding surface disposed between the rollers and defining a laterally extending channel for receiving a rail. The grinding surface may be a circumferential surface of a rolling member, or be rigidly secured to the sole of the shoe, for example.

In some instances, the sole defines a cavity having an opening at the lower surface of the sole, with the roller partially disposed within the cavity and extending through the cavity opening.

In some such instances, the roller axle is mounted to a support cup spanning the roller and disposed within the sole cavity. The support cup may be removable from the sole cavity, or the support cup, roller and axle may be removable from the sole cavity as a unit.

In some embodiments, the support cup is selectively positionable in the cavity in a first position for rolling, in which the roller extends through the cavity opening, and a second position for walking, in which the roller is fully recessed within the cavity. Preferably, the cup encloses the roller within the cavity in said second position for walking.

The roller may have one or more of the following features: the roller is elongated, the roller is barrel-shaped, the roller is a wheel, the roller contains a bearing (such as one with rolling elements) supporting the roller on the axle, and/or the roller is cylindrical.

In many embodiments, the roller is disposed in an arch region of the sole.

In some arrangement, the roller defines a rolling surface spanning a distance of at least about 2.0 inches (5 centimeters), preferably at least 2.5 inches (6.3 millimeters), along the sole. The rolling surface preferably spans at least about 15 percent (more preferably, at least about 20 percent, and most preferably at least about 25 percent) of an overall length of the shoe.

In some advantageous constructions, the axle is secured to the sole through a compliant mount that allows tilting of the axle with respect to the sole to vary direction of travel while rolling upon the roller.

In some cases, the axle defines a canted kingpin axis about which the axle rotates to induce yaw with respect to a rolling direction. The axle may be secured to the sole through a compliant mount, for example, that resiliently deforms as the axle is rotated about its kingpin axis.

In some embodiments the axle carries two rollers, one disposed on either side of the kingpin axis. The rollers may be cylindrical, for example, mounted for rotation about the axle through separate bearings containing rolling elements. Preferably, a fore-aft distance between midplanes of the rollers is about 3.0 inches (76 millimeters), or about 30 percent of an overall length of the sole.

The kingpin axis is defined in part, in some embodiments, by a pin of the axle disposed for rotation within a socket of axle mounting structure secured to the sole.

The axle is preferably disposed in an arch region of the sole, between the forward region and an exposed heel region of the sole, and may be selectively removable from the sole for walking.

In one preferred embodiment, the shoe also has a roller mounted to rotate about a fixed axle laterally spaced from the axle with the canted kingpin axis, for additional stability during rolling. Preferably, the fixed axle is disposed on a side of the kingpin axis facing an inner side of the shoe.

In some embodiments, the shoe has at least two rollers, each mounted for rotation about corresponding, independent axles. Each axle defines a canted kingpin axis about which the axle rotates to induce yaw with respect to a rolling direction, with the axles spaced apart laterally across the sole.

In some configurations, each axle carries two rollers, one disposed on either side of its kingpin axis. Preferably, the two rollers together define a wheelbase of about 20 percent of an overall length of the shoe.

In some cases, each kingpin axis extends upward toward an adjacent side of the shoe, for particularly aggressive maneuverability.

Preferably, both axles and their associated rollers are completely disposed within a shoe width defined by the exposed forward region of the sole, so as to not add to the overall width of the shoe.

In some embodiments, the roller defines at least two support surface contact points separated by at least 1.5 inches (38 millimeters). The contact points may be defined on a single rolling member, or on at least two independently rotatable rolling members. In some cases, the rolling member is shaped to engage a flat, horizontal supporting surface at one of the contact points in a first roller tilt direction, and the other of the contact points in a second roller tilt direction. In some other cases, the rolling member is shaped to engage a flat, horizontal supporting surface at both contact points simultaneously.

According to another aspect of the invention, a shoe defines a normal walking direction and has a sole defining a forward region positioned beneath toes and at least part of a ball of a foot received within the shoe. The sole has a lower surface exposed across the forward region to engage a supporting surface for walking thereon. The shoe also has a roller secured to the sole and disposed rearward of the forward region. The roller is mounted to rotate about an axle defining a primary axis of rotation non-perpendicular to the walking direction as viewed from above the shoe.

Various embodiments of this aspect of the invention include features recited above with respect to embodiments of the first-recited aspect.

According to a third aspect of the invention, a shoe defines a normal walking direction and has a sole having a lower surface exposed for engaging a supporting surface for walking thereon. The sole defines a cavity having an opening at the lower surface of the sole, with a roller partially disposed within the cavity and extending through the cavity opening. The roller is mounted to rotate only about a primary axis of rotation for rolling along a support surface in a direction other than the walking direction.

Various embodiments of this aspect of the invention also include features recited above with respect to embodiments of the first-recited aspect.

According to a fourth aspect of the invention, a shoe has a heel portion and a toe portion and defines a normal walking direction, and has a flexible sole with a lower surface exposed for engaging a supporting surface in a walking mode. The sole defines a cavity extending into the sole rearward of the toe portion from an opening at the lower surface and at least partially containing a removable roller extending through the opening for rolling against the supporting surface in a rolling mode. Notably, the roller is mounted to rotate about an axis extending at an angle of between about zero and 45 degrees to the walking direction, as viewed from above the shoe.

Various embodiments of this aspect of the invention also include features recited above with respect to embodiments of the first-recited aspect.

According to a fifth aspect of the invention, a rolling shoe has a sole, a steerable truck assembly with a pair of rollers mounted to rotate about an axle secured to the sole through a compliant mount that allows tilting of the axle with respect to the sole to vary direction of travel while rolling upon the roller, and a non-steerable roller mounted to rotate about a fixed axle laterally spaced from the axle of the steerable truck assembly.

Various embodiments of this aspect of the invention also include features recited above with respect to embodiments of the first-recited aspect.

According to a sixth aspect of the invention, a method of personal locomotion is provided. The method includes donning a pair of shoes each defining a normal walking direction and having a sole defining a forward region positioned beneath toes and at least part of a ball of a foot received within the shoe and having a lower surface exposed across the forward region to engage a supporting surface for walking thereon; and a roller secured to the sole and disposed rearward of the forward region, the roller mounted to rotate about an axle defining a primary axis of rotation extending at an angle of between about zero and 45 degrees to the walking direction, as viewed from above the shoe, for rolling sideways along a support surface. The method also includes accelerating in a desired direction corresponding to the normal walking direction by engaging the forward regions of the soles against a support surface, and then repositioning the shoes to engage the rollers against the support surface, to roll in the desired direction at an angle to the normal walking direction defined by the shoes.

In some cases, the support surface is of a sidewalk.

The step of accelerating may include walking or running upon the forward regions of the shoe soles, for example.

In some cases, the shoes are repositioned to roll in a direction substantially perpendicular to the normal walking direction defined by the shoes.

In some practices of the method, the repositioning of the shoes includes lifting each shoe from the support surface, rotating the shoe away from the direction of acceleration, and then engaging the roller upon the support surface.

Various embodiments of this method also involve shoes with other features recited above with respect to embodiments of the first-recited aspect.

According to yet another aspect of the invention, a steerable truck assembly includes a rigid mounting bracket defining compartments on either side of a canted kingpin, an axle extending generally perpendicular to the kingpin and carrying a pair of rollers, with the axle mounted for angulation about the kingpin for steering, and compliant bushing blocks disposed within the compartments of the bracket and arranged to be resiliently compressed between the bracket and a broad adjacent surface of the axle during angulation from a neutral axle position, to bias the axle toward its neutral position.

In some embodiments, the bushings are wedge-shaped and/or molded of polyurethane.

Advantageously, some embodiments of the truck assembly have an overall height of less than about 1.0 inch (25 millimeters), and are well-suited for direct mounting beneath shoe soles.

In some cases, the compartments are defined on either side of a central bracket web extending from a bracket base to a side of the kingpin.

In some embodiments, the axle has a central body defining an open circular slot for receiving the kingpin, with the slot encompassing, in cross-section, more than 180 degrees of a defined circle, for radially retaining the pin.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
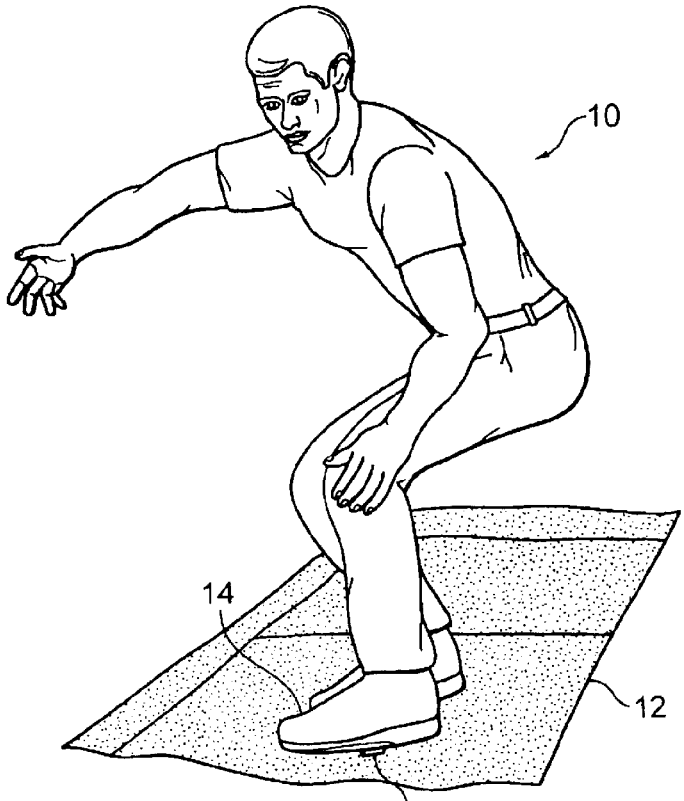
FIGS. 1 and 2 illustrate sidewalk "surfing" and grinding, respectively, with shoes having rollers in their soles.
Figure 2:
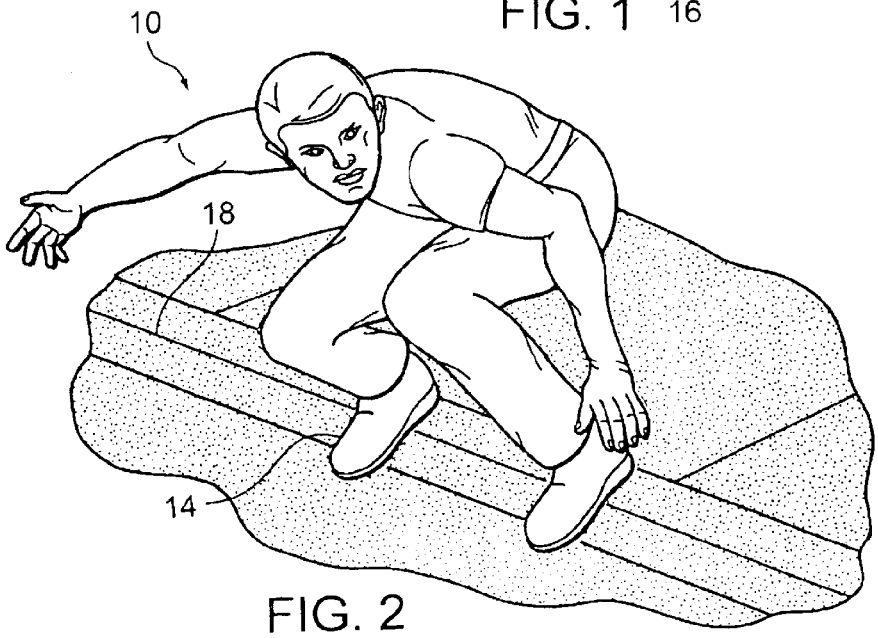

FIGS. 1 and 2 illustrate that many of the attitudes or stances assumed by surfers and skateboarders may also be obtained with shoes having rollers in their soles, with the rollers specifically adapted to roll along in a direction other than the walking direction, in accordance with several aspects of the present invention. For example, FIG. 1 shows a user 10 rolling along a concrete sidewalk 12 with his feet oriented generally perpendicular to his direction of motion. Shoes 14 have rolling elements 16 in the arch region of their soles, enabling the user to balance his or her weight directly on the rolling elements for lateral motion. Preferably, there is sufficient room in the toe region of the flexible shoe soles, beyond the rolling elements 16, to allow the user to run or walk on the toe regions without engaging the rollers. This can be useful for obtaining a running start before jumping into a surfing position on the rollers for continued motion. In some instances, the rollers may enable surfing along an edge 18 of a curbstone, as shown in FIG. 2, or an inclined railing or hand rail.

Figure 3:
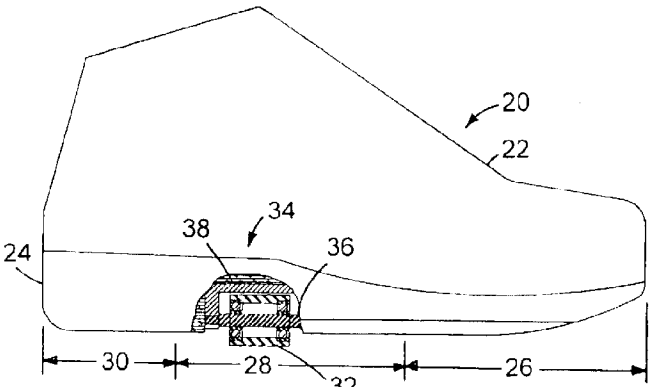
FIGS. 3–5 are side, back and bottom views, respectively, of a first shoe.
Figure 4:
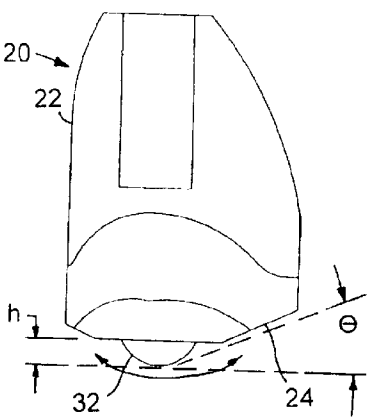
Figure 5:
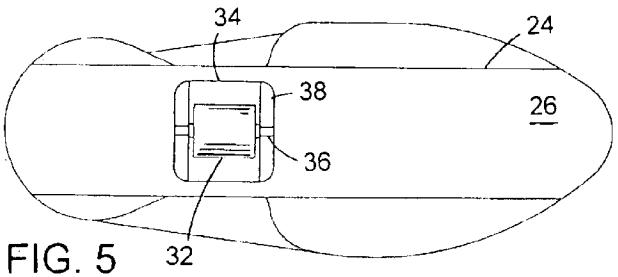

Referring first to the embodiment illustrated in FIGS. 3–5, shoe 20 has an upper portion 22 and a sole 24. Not much detail is shown on upper 22, as the shoe upper may be in any suitable form known in the art. Upper 22 may extend upward to cover the wearer's ankle, as illustrated, or may be of a lower cut. Alternatively, upper 22 may extend up the wearer's calf in the form of a boot. Upper 22 may be of a flexible material or may be of rigid form, as employed in ski and skate boot shells, for example. Likewise, sole 24 may be flexible or rigid, depending on the application. In one preferred embodiment, sole 24 is molded of a flexible elastomer with a forward region 26, an arch region 28 and a heel region 30. The flexibility of forward region 26, which covers the toe and ball portions of the foot, and the flexibility of the transition between forward region 26 and arch region 28, enable sole 24 to flex during normal walking and during "toe-walking," in which the wearer walks only upon the forward portions of their feet, as called "tip-toeing" by children.

A cylindrical roller 32 is mounted within a cavity 34 in arch region 28. Roller 32 is mounted for rotation about an axle pin 36 that extends in the fore-aft direction of the shoe, such that roller 32 is free to rotate as indicated by arrows in FIG. 4. In this illustration, roller 32 is only about 1.0 inch (25 millimeters) long and about 1.25 inches (32 millimeters) in diameter, with a cylindrical outer surface. Examples of other roller configurations are discussed below. A rigid axle mount cup 38, or other support, is insert-molded into sole 24 to provide the mounting structure to which axle pin 36 is releasably secured. The ends of axle pin 36 snap into corresponding recesses at the forward and aft edges of cup 38, and can be released from their recesses manually by pulling roller 32 from its cavity. Thus, roller 32 can be easily removed by the wearer, without the use of hand tools and without having to remove the shoes.

As can be seen in FIGS. 3 and 4, the outer surface of roller 32 extends below the lowermost part of sole 24, so that the wearer can engage roller 32 against a flat supporting surface, such as a sidewalk, without engaging any other portion of the sole. Additionally, as seen in FIG. 4, the lateral edges of sole 24 are chamfered or otherwise relieved to provide ground clearance when the shoe is tipped to either side on roller 32. Preferably, the sole is relieved give a tilt clearance $\theta$ of at least about 10 degrees in at least one direction, with the roller sufficiently embedded to only have an exposed height 'h', below the lowest surrounding sole surface, of no more than about 0.5 inch (13 millimeters).

Figure 5B:
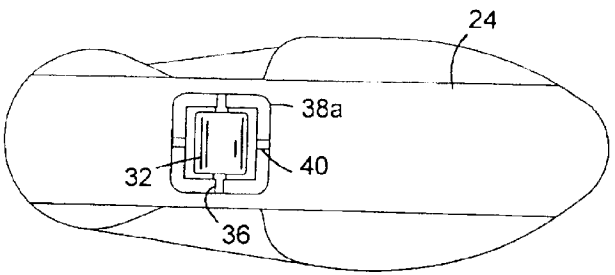
FIGS. 5A and 5B are alternate bottom views of the first shoe.
Figure 5A:
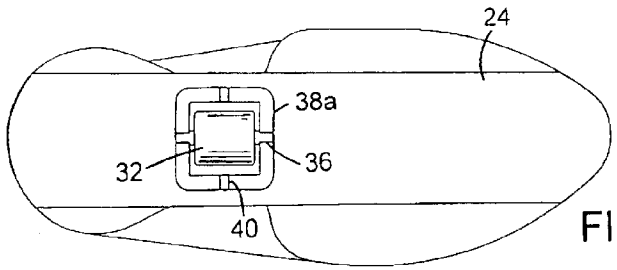

In the embodiment of FIGS. 5A and 5B, axle pin mounting cup 38*a* defines four axle pin mounting recesses 40, one set in its fore and aft edges for mounting roller 32 in the side-rolling orientation of FIG. 5A, and another set in its side edges for mounting roller 32 in a forward rolling direction as shown in FIG. 5B. Again, roller 32 is conveniently removed for normal walking, but can be quickly snapped into place in either illustrated orientation, enabling the wearer to selectively configure the shoes for skating or surfing modes.

Figure 6:
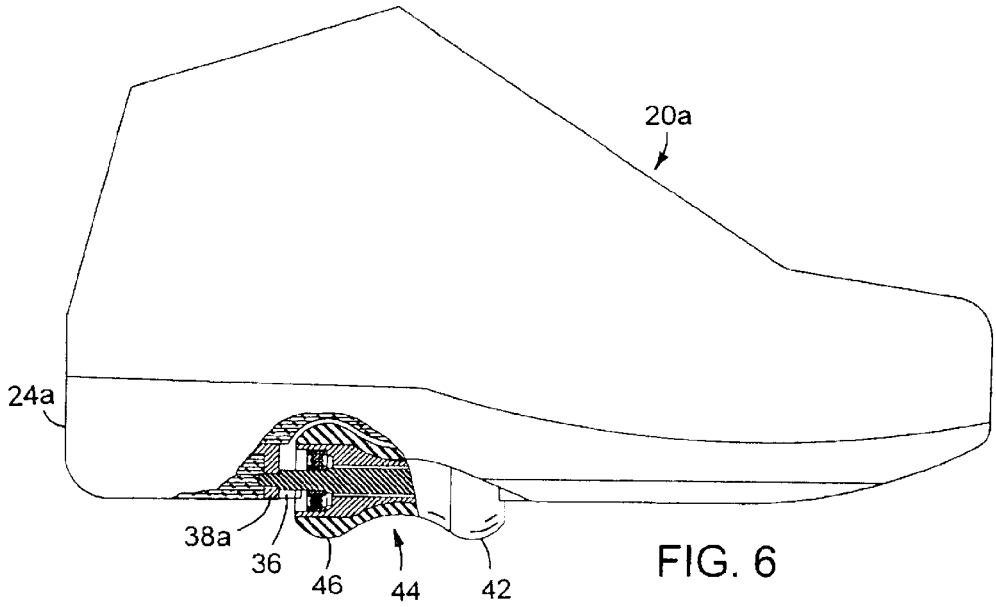
FIGS. 6 and 7 are side and bottom views, respectively, of a second shoe.
Figure 7:
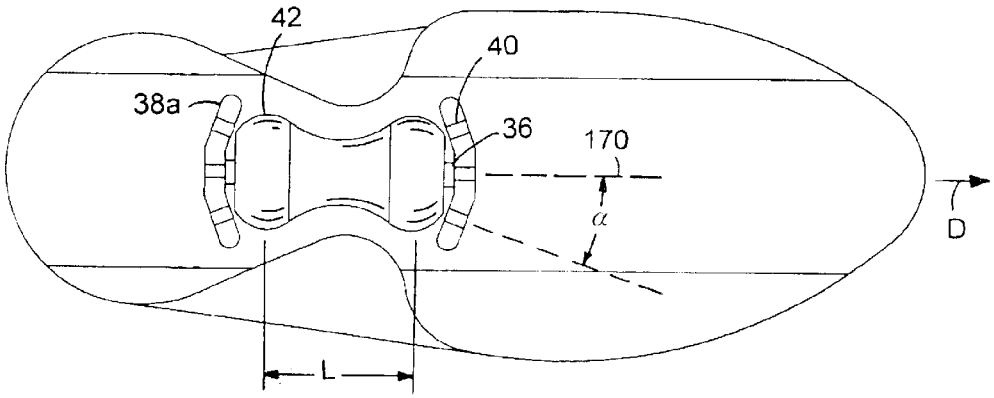

In the embodiment of FIGS. 6 and 7, shoe 20*a* has an hourglass-shaped roller 42 positioned in its arch region, with a maximum outer diameter of about 2.0 inches (51 millimeters) and a central diameter of about 1.0 inch (25 millimeters). By its shape, roller 42 defines a central channel 44 for receiving a laterally extending support surface feature, such as an edge of a curbstone (see FIG. 2), or a stair railing for extreme sports maneuvers. When rolling along a flat supporting surface, roller 42 engages the surface only on its two, spaced-apart maximum diameter regions 46, providing low rolling contact area and corresponding rolling resistance, while also providing a relatively long extent "L" of contact for stability. In this case, longitudinal rolling extent "L" is about 2.75 inches (70 millimeters), or about 25 percent of the overall length of the sole 24*a*. The curvature shown in these views of the rolling surface of roller 42 at its two ends, beyond rolling extent "L", gives some steering effect when the shoe is tilted fore-aft to place only one end of the roller in contact with the ground.

Another feature of this embodiment is that the axle pin supporting structure 38*a* embedded in sole 24*a* defines multiple sets of axle pin receivers 40 defining axle axes arranged at different angles, allowing roller 42 to be inserted in any of three distinct positions. In the center position, as shown, roller 42 rolls only about a fore-aft axis 170 aligned with the normal walking direction "D", such that the user may roll exactly sideways. At other times, the user may wish to roll in a direction slightly angled from the sideways direction. If such is the case, the user may quickly snap roller 42 from its central position and reinsert it in one of the other two positions, with rolling axes displaced from the fore-aft direction by an angle $\alpha$ of about 15 degrees. For surfing stability, it may be desired to place the roller 42 of a forward shoe in a skewed position while leaving the roller of a rearward shoe in a centered position.

Figure 8:
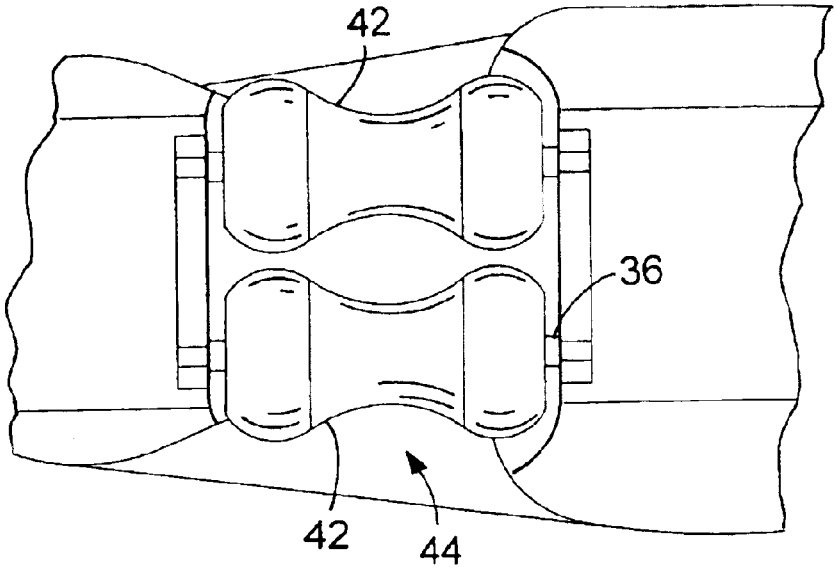
FIG. 8 is a partial bottom view of a third shoe.
Figure 9:
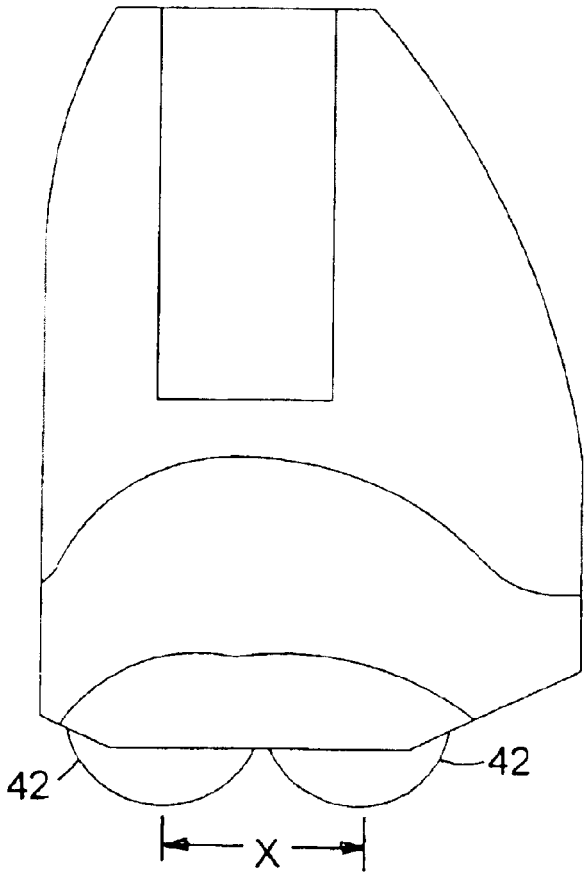
FIG. 9 is a back view of the third shoe.

For even more stability, one or both shoes may be equipped with twin rollers spaced apart along the width of the shoe. For example, FIGS. 8 and 9 illustrate a shoe with two rollers 42 mounted in parallel in the arch region of the shoe sole. In this case, both rollers 42 roll about parallel axes running fore-aft along the shoe, with their central channels 44 aligned. As with the above-described embodiments, rollers 42 are removable for walking or running. The rollers contact the ground at points separated a distance "X" along the direction of rolling travel, giving enhanced stability for each shoe. This can be particularly important for reducing inner thigh stress during prolonged use. Preferably, distance "X" is at least about 2.0 inches (51 millimeters).

Figure 11:
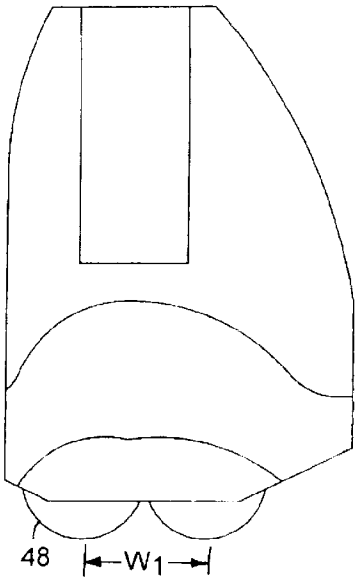
FIGS. 10–12 are side, back and bottom views, respectively, of a fourth shoe.
Figure 10:
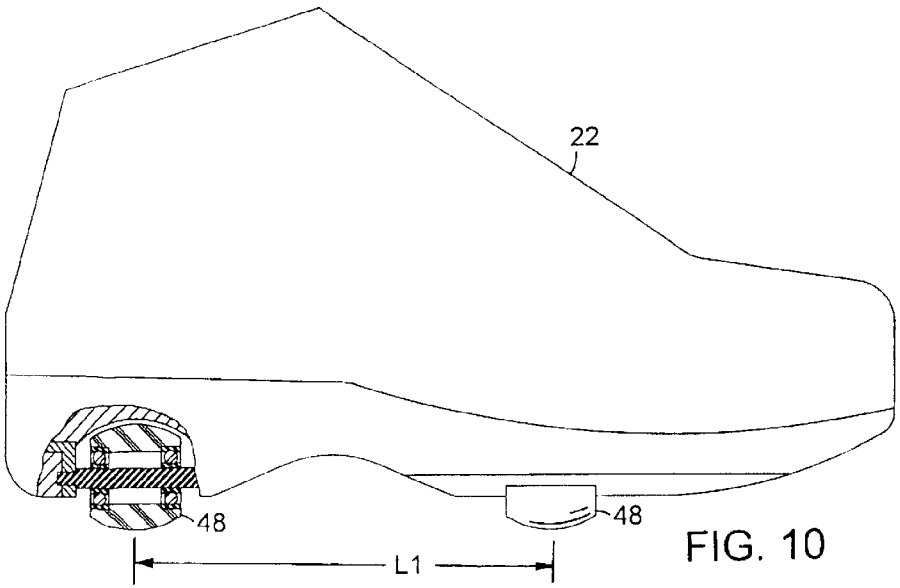
Figure 12:
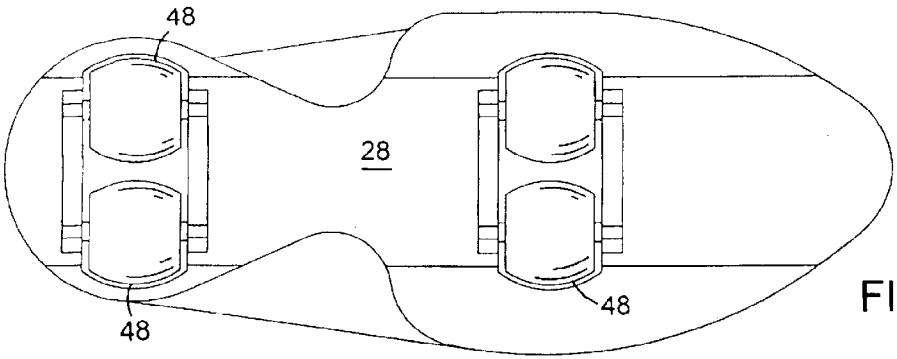

The shoe illustrated in FIGS. 10–12 has four rolling elements 48 arranged at four corners of a rectangle. Two rollers 48 are arranged in parallel in the heel region of the shoe, while the other two rollers 48 are arranged in parallel just forward of the arch region of the shoe, such that the pattern of rollers encompasses the arch region. This arrangement of rollers provides excellent stability as the ground contact points define and encompass a broad planar area of length $L_1$ of about 3.0 inches (76 millimeters) and width $W_1$ of about 2.0 inches (51 millimeters). Each roller 48 rolls about a fore-aft axis and is of barrel shape, with the barrel curvature enabling some steering by tilting the shoe forward or aft for rolling contact on only either the rear wheels or the front wheels.

Figure 13:
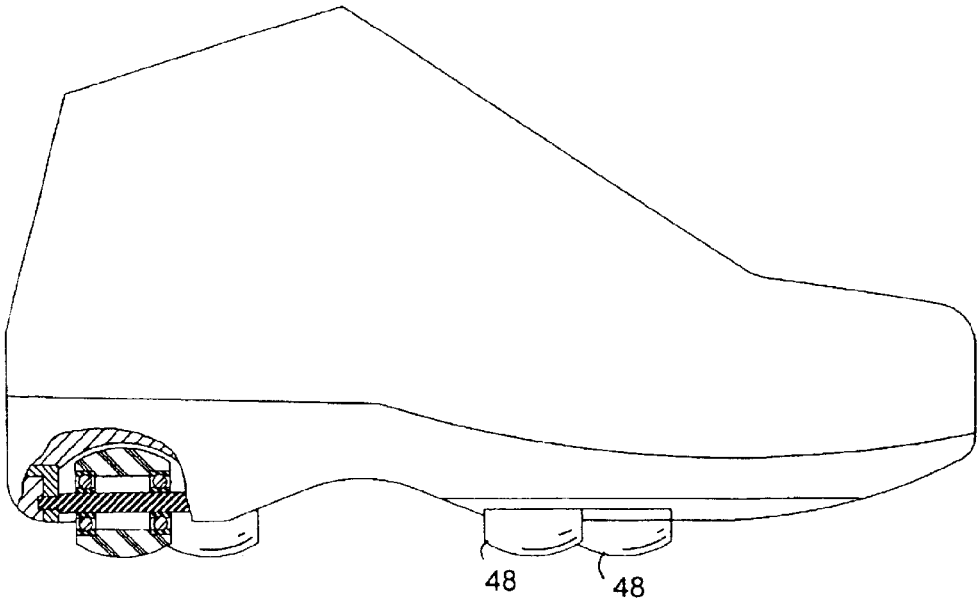
FIGS. 13 and 14 are side and bottom views, respectively, of a fifth shoe.
Figure 14:
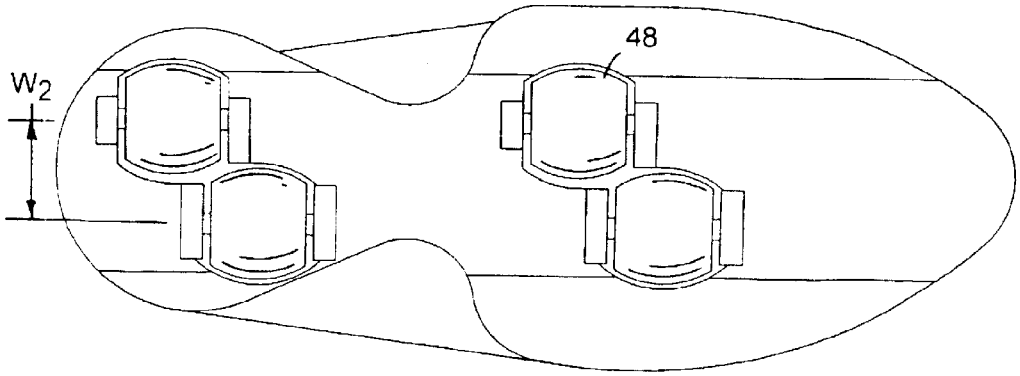

Other side-rolling roller arrangements are also envisioned. For example, FIGS. 13 and 14 shoe a shoe with four rollers 48 arranged in an offset pattern, with their ground contact points defining corners of a planar parallelogram. This enables the use of rollers with large rolling diameters while keeping their lateral separation $W_2$ narrower than if the rollers were placed side-by-side. Rollers 48 may be mounted for easy removal for walking, as discussed above, or securely mounted in the sole for use only as a rolling shoe, as shown. Preferably, the forward rollers 48 are mounted far enough from the toe of the shoe to enable toe-walking.

Figure 15:
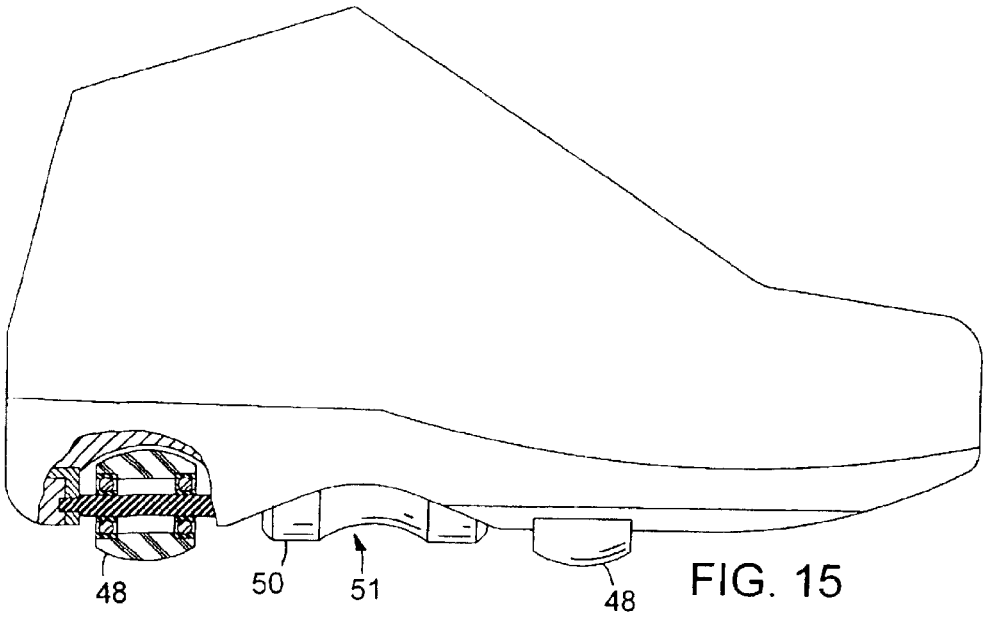
FIGS. 15 and 16 are partial side and bottom views, respectively, of a sixth shoe.
Figure 16:
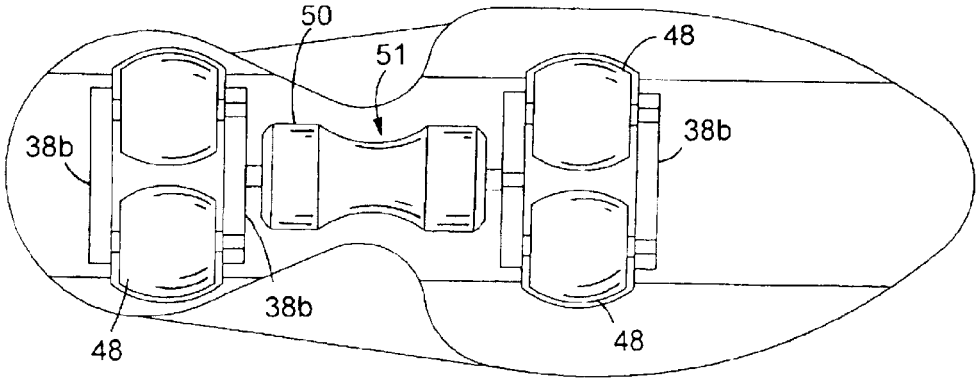

Side-rolling elements 48 may also be combined with arch rollers or skid plates for both side-rolling and grinding. FIGS. 15 and 16 show a shoe with the four-roller arrangement of the shoe of FIG. 10, but with the addition of a grinding roller 50 in the arch region of the shoe sole, between the fore and rear rollers 48. Rollers 48 project farther from the sole than does grinding roller 50, such that for side-rolling, only rollers 48 engage the ground. However, the user may jump from a side-rolling mode onto a railing to grind on arch roller 50, with the railing received in the central reduced diameter portion 51 of the grinding roller. Each of the rollers 48, 50 in this embodiment may be removed for walking mode or for replacement, by snapping the forward end of each roller axle out of a corresponding recess in supporting structure 38*b*, and then tilting the axle away from the sole and pulling the other end of the axle out of a corresponding socket in the supporting structure.

Figure 17:
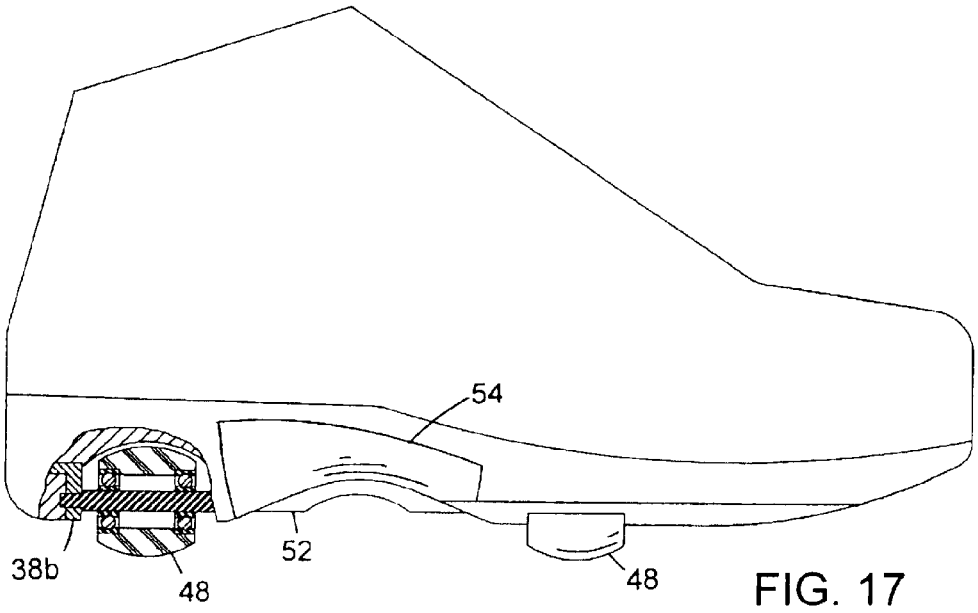
FIGS. 17 and 18 are partial side and bottom views, respectively, of a seventh shoe.
Figure 18:
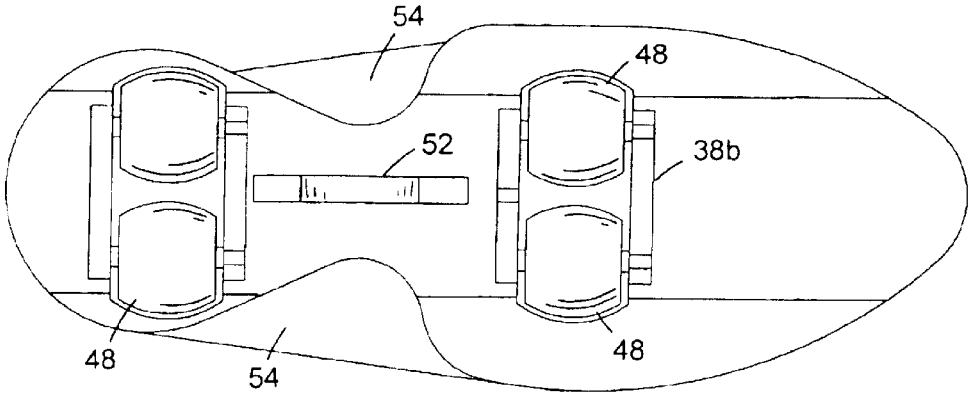

As an alternative to a grinding roller, a grinding plate 52 can be employed, embedded in the sole along the centerline of the shoe, as shown in FIGS. 17 and 18. Grind plate 52 has a concave central portion for receiving and sliding along a railing or such. In this particular embodiment, the shoe is also equipped with slide plates 54 overlaying the sides of the sole in the arch region of the shoe, for engaging a rail in combination with grind plate 52 for certain maneuvers.

Figure 19:
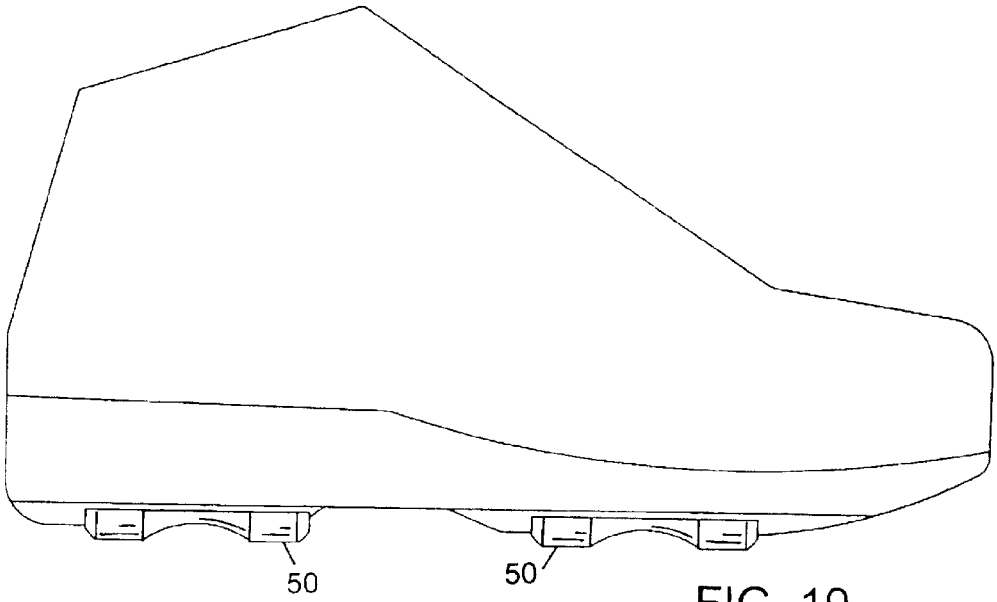
FIGS. 19 and 20 are side and bottom views, respectively, of an eighth shoe.
Figure 20:
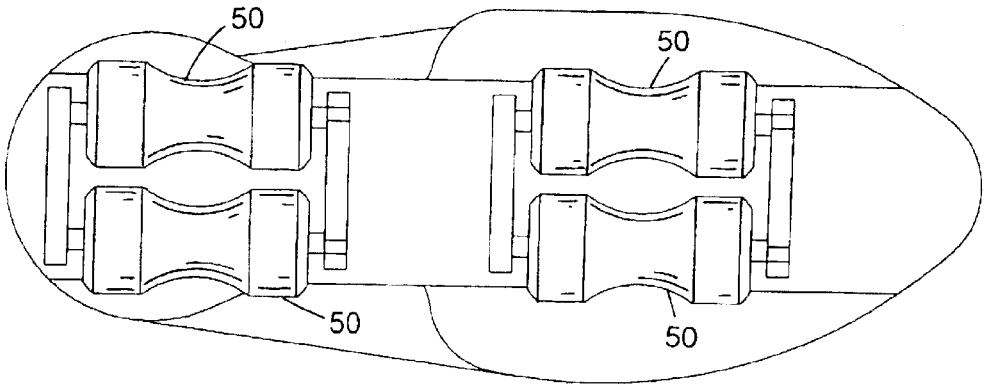

In another quad roller arrangement shown in FIGS. 19 and 20, four elongated, concave rollers 50 are arranged in two parallel rows, with two rollers in the heel region and two rollers forward of the arch region. Together, the rollers provide eight discrete ground contact points upon which the shoe can roll in sideways manner, and define two separate grinding channels.

Figure 21:
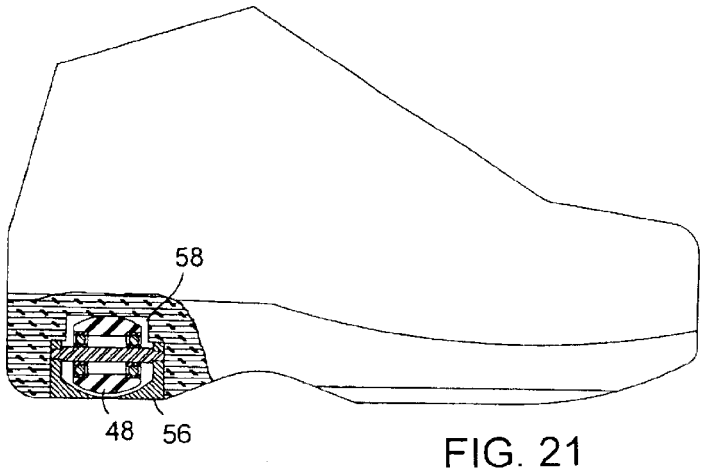
FIGS. 21–23 are side, bottom and back views, respectively, of a ninth shoe.
Figure 22:
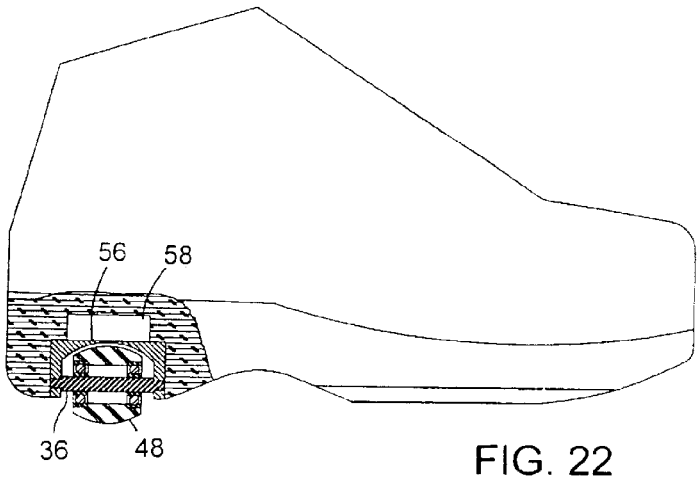
Figure 23:
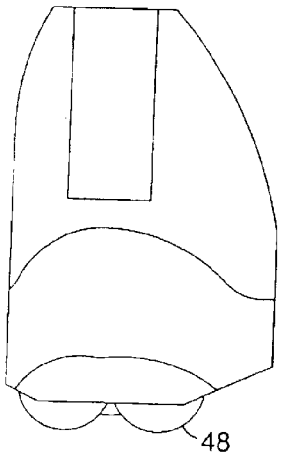

The above embodiments have all been illustrated as having rolling elements that are secured to supporting structure permanently embedded in the sole of the shoe. In other cases, the supporting structure is removable. For example, FIGS. 21–23 show a shoe with two heel rolling elements 48 that can be exposed for rolling (FIGS. 22 and 23) and then rearranged for walking (FIG. 21). Rollers 48 roll about parallel axle pins 36, which are securely mounted at their ends to two sides of a removable roller cap 56. Placed into heel cavity 58 with its closed end inward (FIG. 22), cap 56 positions rollers 48 such that their rolling surfaces extend below the surrounding sole surface of the shoe, for rolling upon the ground. For walking or running, cap can be removed by hand and reinserted into cavity 58 with its closed side out, rollers 48 are completely enclosed and protected, with the bottom surface of cap 56 flush with the bottom sole surface of the shoe. A slot (not shown) may be provided for popping the roller cap back out of the sole with a coin or key. Although two heel rollers are shown, other arrangements include a single heel roller, a heel roller in combination with a toe roller, or an arch roller or rollers. Single roller caps can be fashioned with square or otherwise symmetrical footprints, such that in a rolling mode the caps can either be placed into the sole to orient the rollers for sideways rolling, or for forward "skate-mode" rolling.

Figure 24:
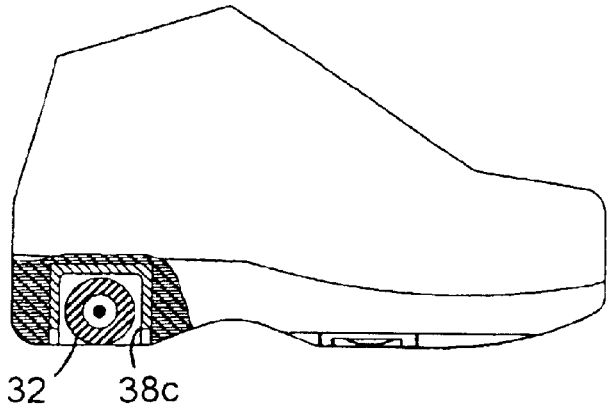
FIGS. 24 and 25 are side and bottom views, respectively, of a tenth shoe, with the rollers recessed for walking.
Figure 25:
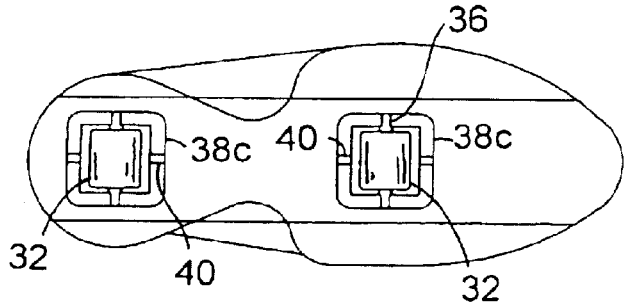
Figure 26:
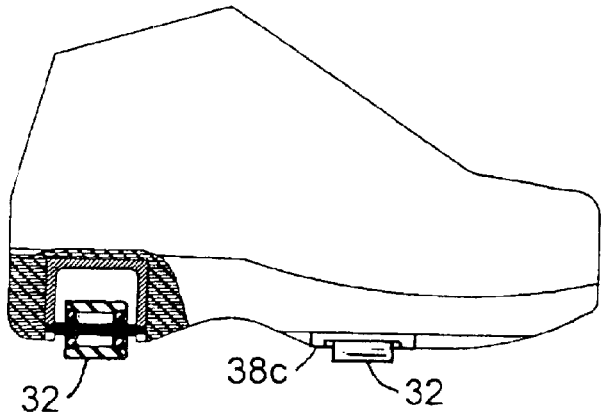
FIGS. 26 and 27 are side and bottom views, respectively, of the tenth shoe, with the rollers exposed for rolling sideways.
Figure 27:
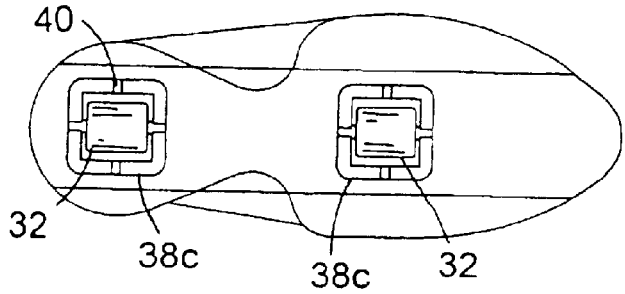

Other means are also envisioned for repositioning shoe rolling elements for walking mode. For example, the shoe shown in FIGS. 24–27 has heel and toe rollers with axle pins that can be snapped into one set of recesses 40 in mounting cups 38*c* to position the axles for sideways wheel rolling (FIGS. 26 and 27), with the wheel rolling surfaces extending below the bottom sole surface. For walking, the user snaps the axle pins from that set of recesses, turns the axles 180 degrees and snaps them back into mounting cups 38*c* in a second set of recesses (FIGS. 24 and 25) that are deeper than the first set of recesses, such that the rollers are positioned entirely above the lower surface of the shoe sole. This mounting means may be employed to advantage with various configurations and combinations of rollers.

Figure 28A:
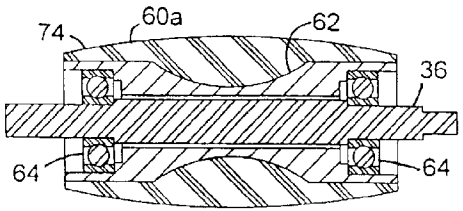
FIGS. 28A–28H show various roller constructions.

Various roller constructions are contemplated, of which FIGS. 28A–28H illustrate a few examples. Referring first to FIG. 28A, roller 42 has a rolling surface 60 of a low friction material, preferably a cast thermoset polyurethane or a thermoplastic, injected-molded polyurethane. Suitable thermoset resins include methylene diisocyanate (MDI), such as Uniroyal B836MDI, and toluene diisocyanate (TDI). Other suitable materials include polyether- or polyester-based polyol or rubber. Materials of different hardness and friction properties may be combined in a single rolling surface, as discussed in U.S. Pat. No. 5,829,757, the disclosure of which is incorporated herein by reference as if fully set forth.

Figure 28E:
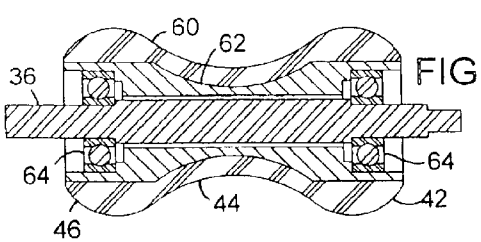
Figure 28F:
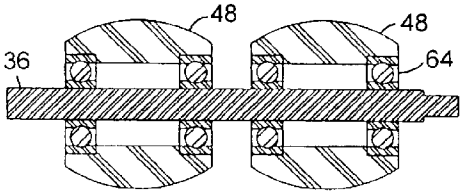
Figure 28B:
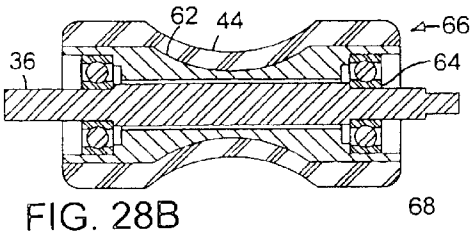
Figure 28D:
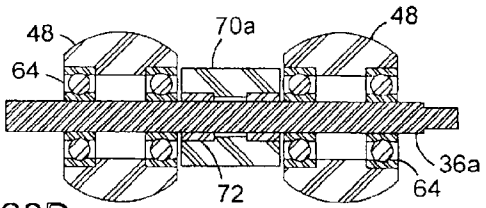
Figure 28C:
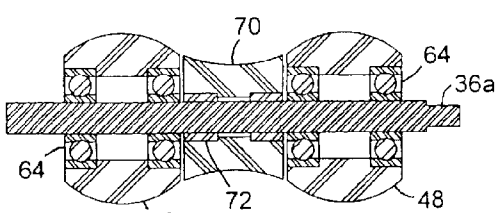

The low friction rolling surface material is injection molded over a rigid core 62 of metal or plastic that defines end bores into which are pressed the outer races of rolling element bearings, such as ball bearings 64, that allow core 62 and low friction material 60 to rotate about axle pin 36. The inner races of bearings 64 axially constrain axle pin 36 as shown. Preferably, the entire assembly shown is replaced when either the bearings or rolling surface wears out. As described above with respect to FIG. 6, roller 42 has a concave central portion 44 and two bulbous, convex ends 46 that define two ground contact points. The roller 66 of FIG. 28B, on the other hand, has cylindrical ends 68 that provide wider ground contact and do not provide steering effect when tilted. Instead of being a one-piece rolling member, the rolling surfaces can be defined across separately rotatable members, as with the roller configuration of FIG. 28C. In this construction, two convex rollers 48 of low friction material are mounted to rotate on bearings 64 on either side of a central, concave roller 70 that is mounted to rotate independently about axle pin 36*a* on bushings 72. Together, the rolling surfaces of the three rolling elements approximate the shape of roller 42 of FIG. 28A, but concave roller 70 may be fashioned of a different material, such as a higher rolling friction material, than convex rollers 48. The outer surface of the middle rolling element 70*a* may also be cylindrical, as shown in FIG. 28D.

As discussed above, barrel-shaped or convex rolling elements can be useful for providing rolling direction control or steering by tilting the rolling axis of the roller or rollers. FIGS. 28E and 28F show two such roller configurations. In FIG. 28E, a single, elongated roller 74 is of the same basic construction as roller 42 of FIG. 28A, except that the outer, low friction material 60*a* has been molded to have a convex outer shape with maximum diameter at the middle of the roller. For steering, axle pin 36 is tilted within the plane of the illustrated cross-section, such as by tilting the shoe with respect to the plane of the ground, to engage the outer surface of the roller on one side or the other of its middle. Similar effect can be obtained with two independently rolling convex elements 48 mounted on the same shaft, as in FIG. 28F, but with some increase in lateral stability.

Figure 28H:
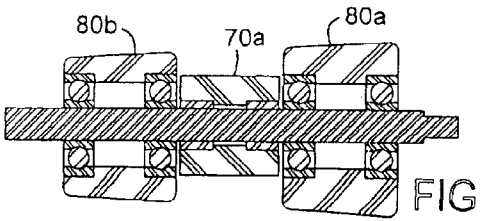
Figure 28G:
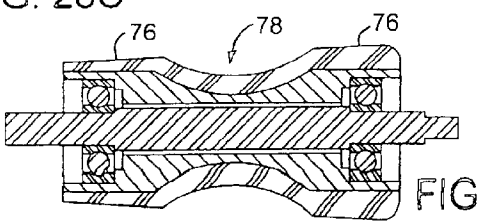

It should also be noted that the outer surfaces of the rolling elements can be tapered to cause a continuous change in the rolling direction as the element rotates about its axle. In FIG. 28G the rolling surfaces of the end portions 76 of roller 78 lie along a conical surface for rolling in a left-turning direction. Two such rolling elements 78 can be placed end to end along the fore-aft centerline of a shoe sole, with their larger ends toward one another, to enable steering by shoe tilting. In a forward direction, with the shoe sole parallel to the ground, the shoe would roll upon the two larger ends of the rollers. In FIG. 28H, tapered rollers 80*a* and 80*b* have outer surfaces that lie in the same conical extension, for similar effect.

Steering control may also be accomplished by mounting the rolling members to the sole with compliant mounts, such as by incorporating a desired amount of compliance in the axle-pin mounting structure within the shoe sole.

Figure 29:
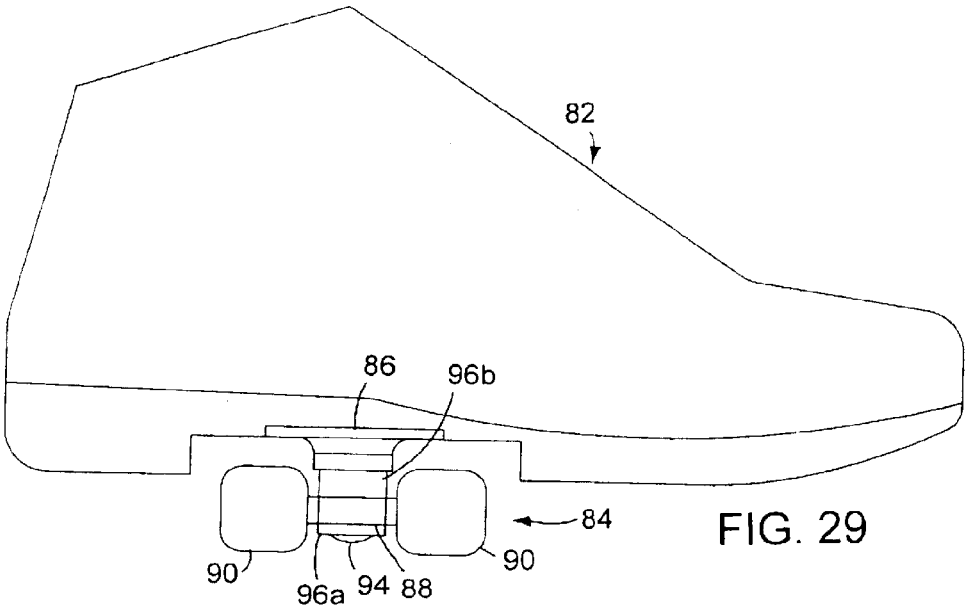
FIGS. 29–31 are side, bottom and back views, respectively, of a right shoe equipped with a steerable truck assembly.
Figure 30:
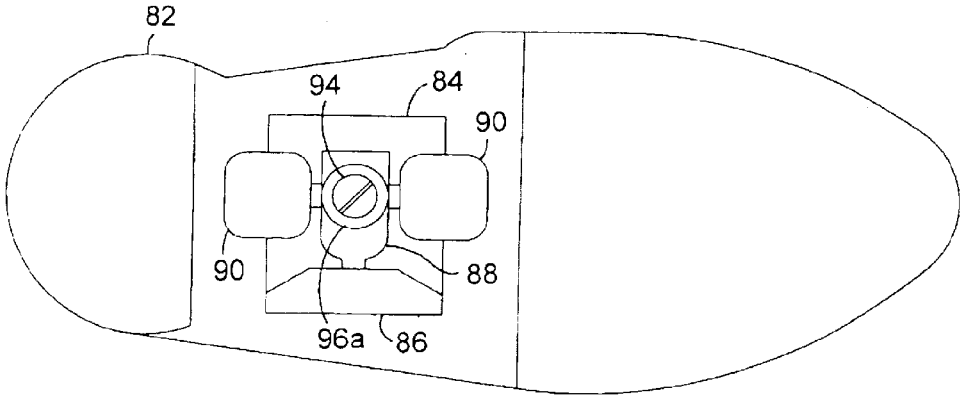
Figure 31:
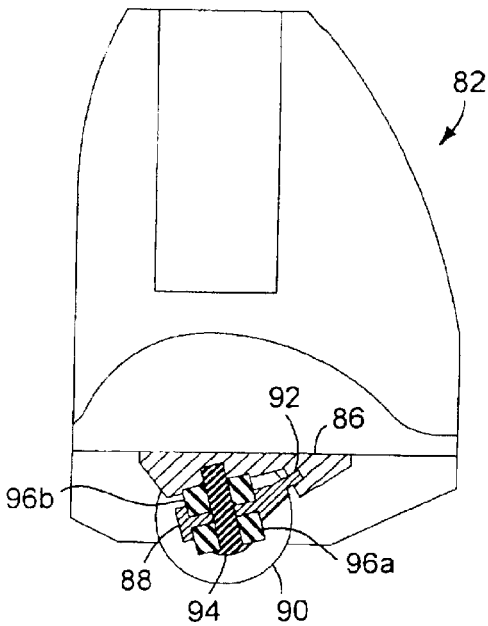

More aggressive maneuverability is provided with a roller or wheel mount that induces a change in the wheel axle orientation in response to a steering input. For example, the shoe 82 in FIGS. 29–31 is equipped with a full axle truck assembly 84, of a similar type to those commonly employed in pairs on skateboards. The base 86 of truck assembly 84 is securely attached to the sole of the shoe in its arch region. Truck assembly 84 carries an axle 88 about which two generally cylindrical rollers 90 rotate independently, of a construction similar to skateboard wheels. As shown in FIG. 31, axle 88 has a pin 92 that is received in a socket of base 86 and can freely rotate within the socket. Axle 88 is also secured to base 86 by canted shoulder bolt 94, between two compliant bushings 96*a* and 96*b*. This arrangement causes axle 88 to slightly rotate in a steering sense (i.e., in the plane of FIG. 30) when it is tilted in the plane of FIG. 29 by compression of bushings 96*a* and 96*b*, providing intuitive directional (i.e., yaw) control.

Figure 32:
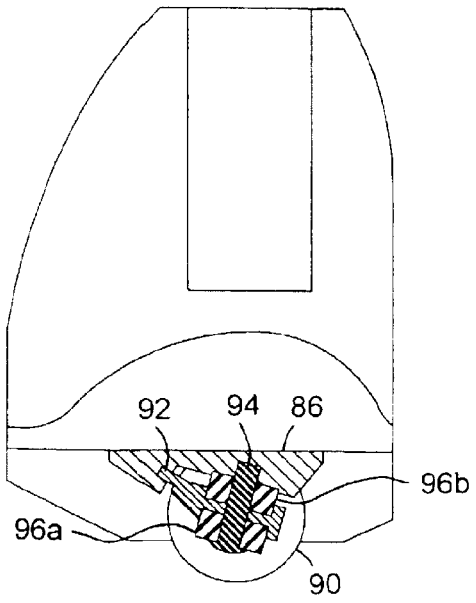
FIG. 32 is a back view of a left shoe equipped with a steerable truck assembly.

Looking in combination at FIGS. 31 and 32, both of a pair of shoes can each be equipped with a truck assembly 84, for independent turning control of each foot in a sideways rolling, "surfing" mode. In the illustrated arrangement, the left foot truck axle 88 has its pin 92 extending to the left, while the right foot truck axle 88 has its pin 92 extending to the right, such that the truck axles pivot in opposite sense when their respective shoes are tilted in the same sense, for turning the truck axles out of phase with one another.

Figure 33:
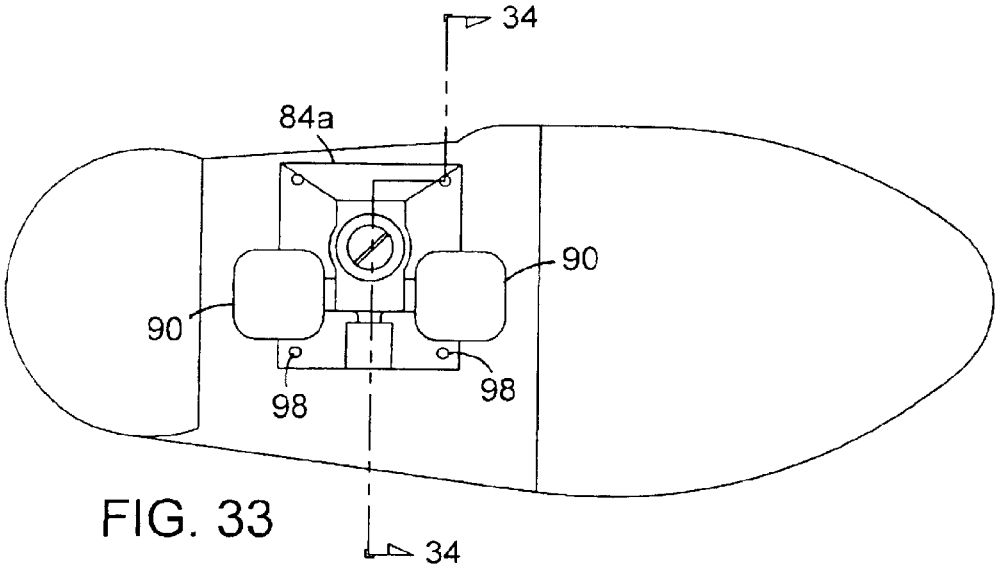
FIG. 33 is a bottom view of a second shoe with a truck assembly.
Figure 34:
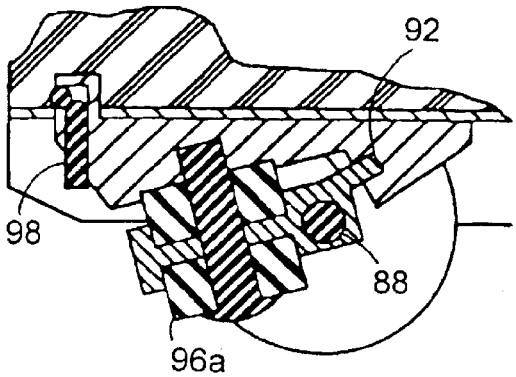
FIG. 34 is a cross-sectional view, taken along line 34—34 in FIG. 33.
Figure 35:
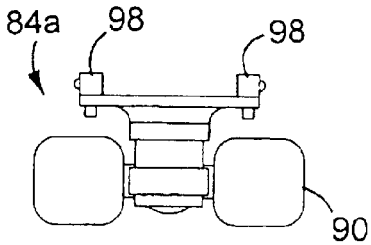
FIG. 35 is a side view of the truck assembly of the shoe of FIG. 33.
Figure 36:
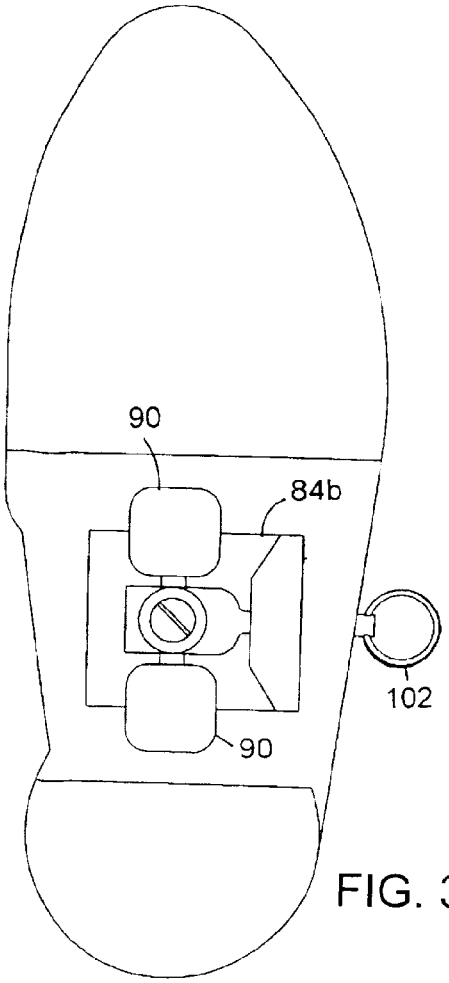
FIGS. 36 and 37 are bottom and back views, respectively, of a third shoe with a truck assembly.
Figure 37:
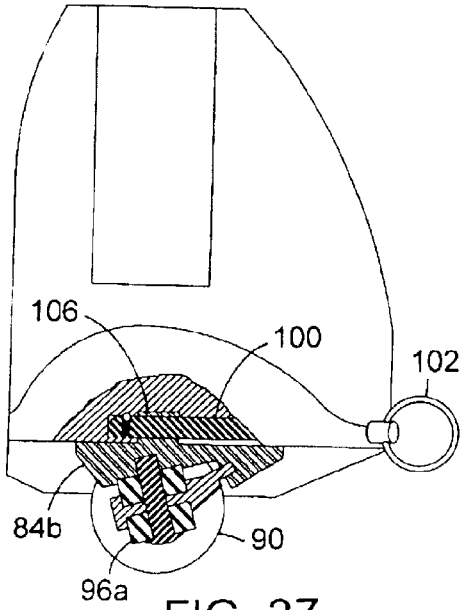
Figure 38:
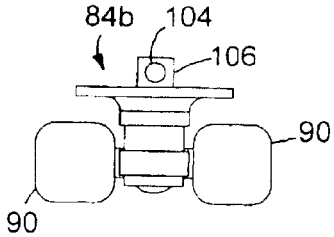
FIG. 38 is a side view of the truck assembly of the shoe of FIG. 36.

Truck assemblies 84 can be mounted to the shoe sole for quick removal to transition to a walking or running mode. In FIGS. 33–35, truck assembly 84*a* has four quick release fasteners 98 for releasably securing the base of the truck assembly to the shoe sole. In FIGS. 36–38, on the other hand, the entire truck assembly 84*b* is secured to the shoe sole with a single quick release pin 100 that is readily grasped and pulled from the shoe sole by ring 102. When in place, pin 100 extends through a hole 104 in a mounting boss 106 extending from the base of truck assembly 84*b*, enabling the truck assembly to be mounted in either of two opposite orientations as desired for particular rolling directions and steering modes.

Figure 39:
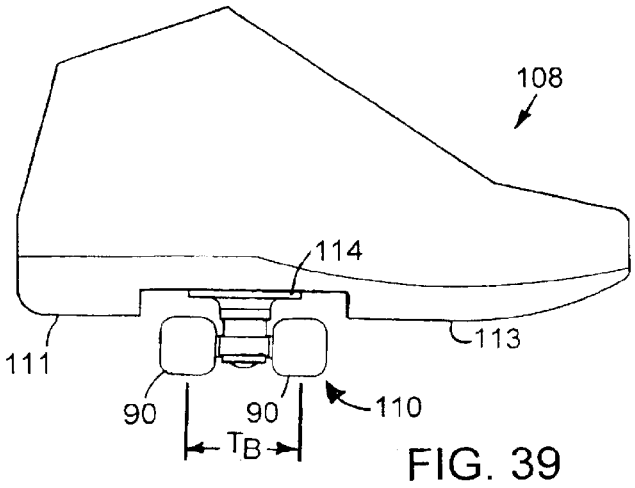
FIGS. 39–40 are side and bottom views, respectively, of a shoe equipped with a double truck assembly.
Figure 41:
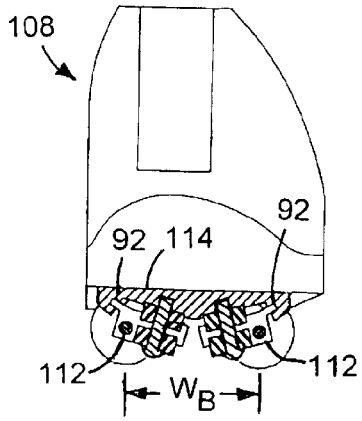
FIG. 41 is a rear view of the shoe of FIG. 39, with the double truck assembly shown in cross-section.
Figure 40:
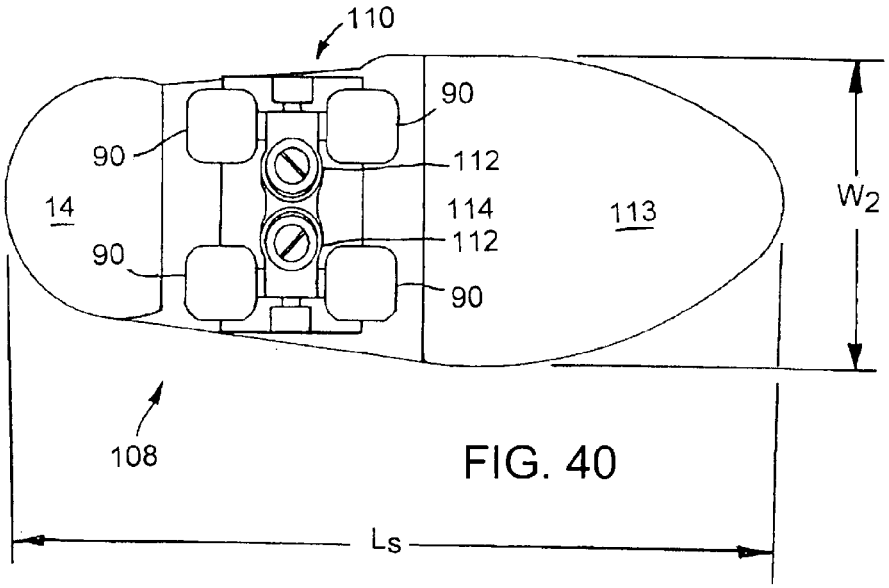

Referring to FIGS. 39–41, shoe 108 has a double truck assembly 110 mounted beneath in the arch region of the sole. Truck assembly 110 supports two independently tiltable wheel axles 112, each with a corresponding pivot pin 92 rotatable within a corresponding socket of the joint truck assembly base 114. Truck axles 112 are arranged in opposition for more aggressive steering sensitivity, giving shoe 108 all of the steering capability of a traditional skateboard, all within the width $W_2$ of the shoe sole rather than requiring a long board on which both feet are placed. Preferably, the overall wheelbase WB of double truck assembly 110 is about 2.0 inches (51 millimeters) or less. In one preferred embodiment, the wheelbase WB is about 2.0 inches (51 millimeters), and the fore-aft distance $T_B$ between wheel midplanes is about 3.0 inches (76 millimeters), in a men's size 9 shoe with an overall sole length $L_S$ of about 12 inches (30.5 centimeters). Thus, the wheel center track width $T_B$ and wheelbase WB were about 30 percent and 20 percent of the shoe length, respectively. With two such shoes 108, a wearer can relatively position his or her feet in any number of positions while rolling sideways and steering, enabling maneuvers impossible with skateboards. As with some of the other embodiments described above, the toe and ball region 113 of the sole of shoe 108 is unobstructed by the truck assembly and its wheels 90, enabling the wearer to toe-walk on the front portion of the sole when not rolling. Heel-walking is also possible on the exposed heel surface 111 of the sole. Preferably, the sole is flexible forward of the arch region, for more comfortable walking. As with the above truck embodiments, double truck assembly 110 can be releasably mounted to the shoe sole.

Figure 42:
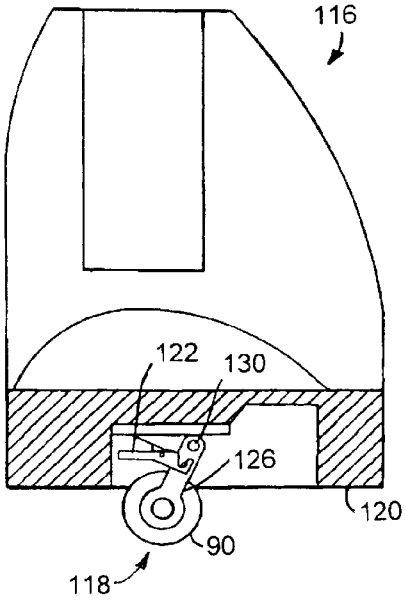
FIGS. 42 and 43 are back views of a shoe with a retractable wheel assembly in the arch region of the sole, with the wheel assembly shown in its extended and retracted positions, respectively, and the sole shown in cross-section.
Figure 43:
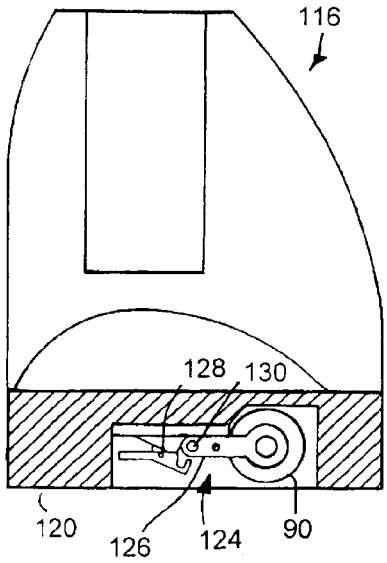
Figure 45:
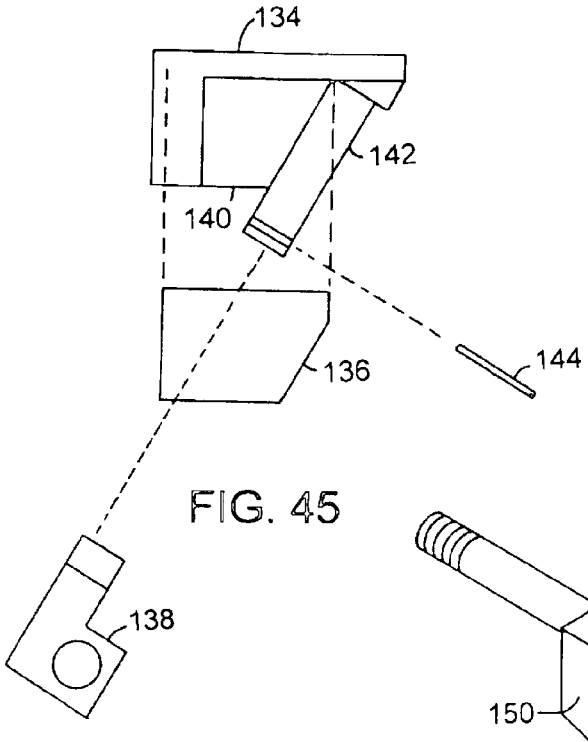
FIG. 45 is an exploded view of the truck assembly of FIG. 44, without the wheels.
Figure 44:
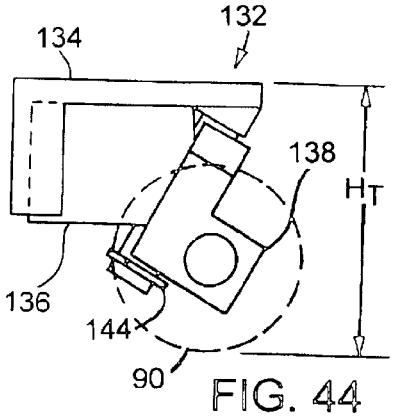
FIG. 44 is a side view of a two-wheeled truck assembly, with the wheels shown in dashed outline.

The shoe 116 of FIGS. 42 and 43 has a two-wheeled roller assembly 118 mounted in its arch region for rolling in a sideways direction (similar to the shoe of FIG. 39), but configured to be readily retractable into the sole of the shoe for walking. In its extended position (FIG. 42), wheels 90 are partially disposed below the lower surface 120 of the shoe sole, and held in that position by a manually operable latch 122. When retracted (FIG. 43), the entire roller assembly 118 is contained within the recess 124 defined in the shoe sole. Latch 122 and axle 126 are both mounted to the shoe to pivot about respective pins 128 and 130, and biased by torsion springs (not shown) toward the positions shown in FIG. 43. It will be understood that such retractability is readily incorporated into several of the above-described roller configurations.

FIGS. 44–47 illustrate a steerable roller truck assembly 132 for use in skates, skateboards, or the like. The illustrated example can be constructed with an advantageously low overall height "$H_T$" of less than about 1.0 inch (25 millimeters), for example, for incorporation into the sideways-rolling shoe embodiments shown above. The three primary components of the assembly are a rigid mounting bracket 134, two compliant wedge-shaped bushings 136, and an axle 138 that carries two wheels 90. To assemble the truck assembly, the two wedge-shaped bushings are first placed into corresponding compartments on either side of a central web 140 of bracket 134. Next, axle 138 is slid over a rigidly mounted pin 142 of bracket 134 until it contacts the angled front surfaces of the bushings. In place, axle 138 cooperates to retain bushings 136 in their compartments. Axle 138 is axially retained on pin 142 by a retaining clip 144 or other fastener means. An adjustable locknut (not shown) at the distal end of pin 142, for example, may be employed to maintain a bushing preload over time, if the axle is configured to leave a gap between the axle and bracket at inner end of the axle as shown. This arrangement also allows bushing compliance to slightly cushion normal wheel loads, as well, and a secondary bushing washer (not shown) may be placed between the axle and the bracket at the inner end of pin 142 if desired. Alternatively, axle 138 may be configured to slide along pin 142 until it contacts a rigid stop surface of bracket 134. During use, torque applied to axle 138 about bracket pin 142 resiliently compresses one or the other of the bushings to enable steering of the axle about pin 142. Bushings 136 can be molded of polyurethane, with a hardness of about 50 to 95 shore A, for example.

Figure 46:
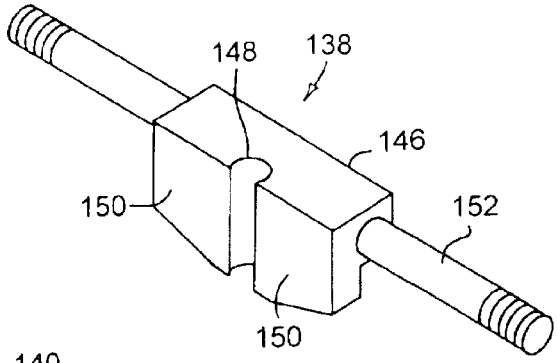
FIGS. 46 and 47 are perspective views of the axle and mounting bracket, respectively, of the truck assembly of FIG. 44.

Referring to FIG. 46, axle 138 has a central body 146 that defines an open circular slot 148 for receiving the pin of the bracket. Slot 148 encompasses, in cross-section, more than 180 degrees of a defined circle, so as to radially retain the pin. The open side of slot 148 accommodates the central web of the bracket. Surfaces 150 adjacent slot 148 bear against the angled surfaces of the bushings in use. An axle pin 152 of about 0.25 inch (6 millimeters) in diameter is rigidly secured within a bore of body 146, and is configured as known in the art to carry the wheels.

Figure 47:
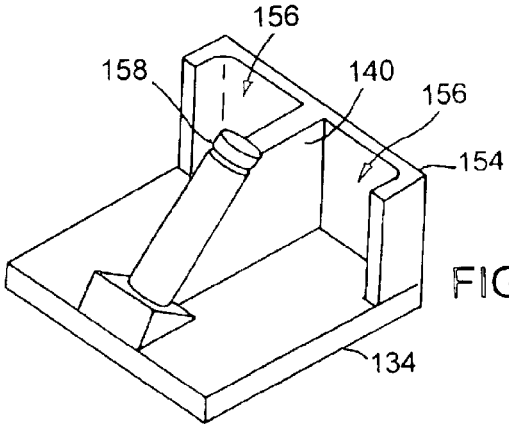

FIG. 47 illustrates the structure of mounting bracket 134. Pin 142 is of about 0.25 inch (6 millimeters) in diameter, pressed into a hole in the lower portion of the bracket and soldered to central web 140 for added support. A rear wall 154 of the bracket extends from the central web around the rear comers of the bracket, to define the cushion compartments 156. A groove 158 at the distal end of pin 142 receives the retaining clip.

Figure 48:
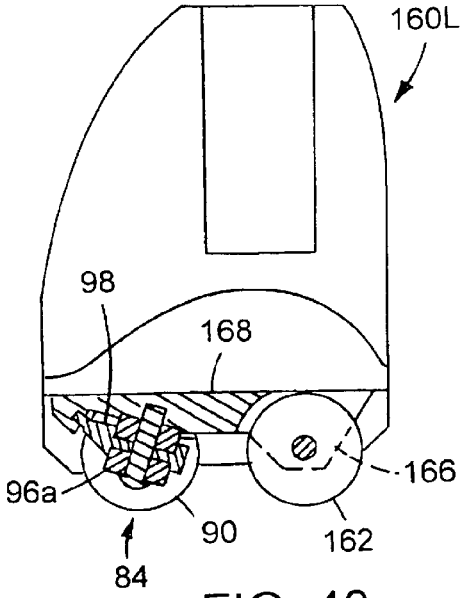
FIGS. 48 and 49 are back views of left and right shoes, respectively, equipped with both steerable truck assemblies and non-steerable wheels.
Figure 49:
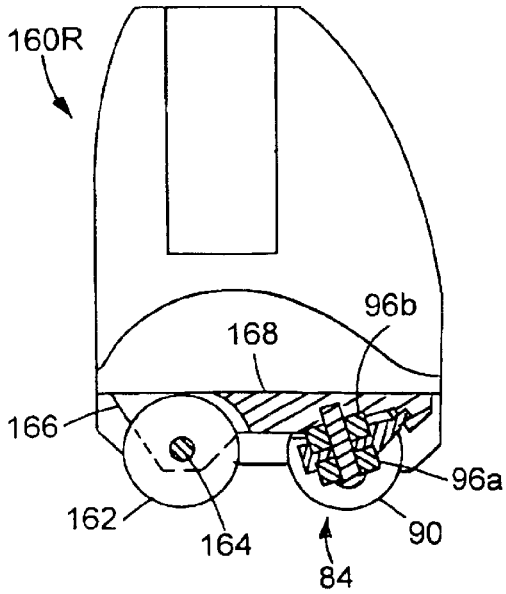
Figure 50:
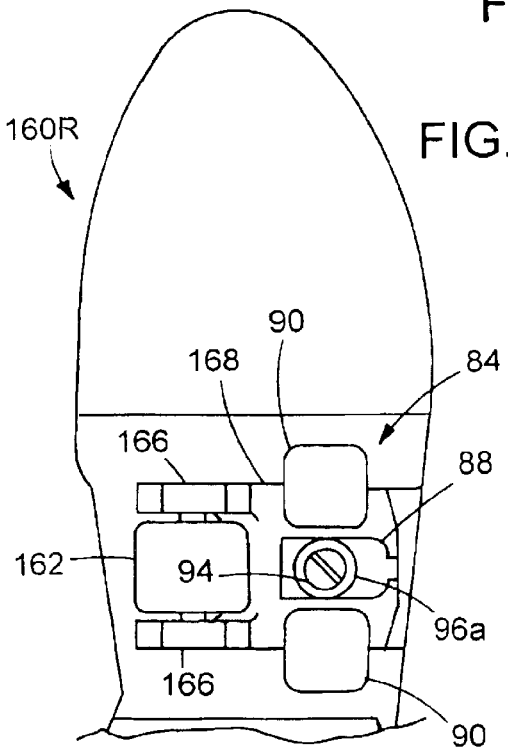
FIG. 50 is a bottom view of the shoe of FIG. 49.

FIGS. 48–50 show a pair of shoes 160L and 160R, each with a steerable truck assembly 84 as well as a non-steerable wheel 162. In each shoe, the non-steerable wheels are shown inboard of the truck assemblies 84 and provide a third contact wheel for added stability of each shoe, as compared with the embodiment of FIGS. 31 and 32. Wheels 162 are each mounted about for rotation about their own axle 164, laterally spaced from the truck assemblies 84 and supported between rigid flanges 166 extending from a common base 168 of the truck assembly.

A number of embodiments of the invention have been described. Nevertheless, it will be understood that various modifications may be made without departing from the spirit and scope of the invention. Accordingly, other embodiments are within the scope of the following claims.

What is claimed is:

1. A shoe defining a normal walking direction and comprising a sole defining a heel region and a forward region, the forward region positioned beneath toes and at least part of a ball of a foot received within the shoe and having a lower surface exposed across the forward region to engage a supporting surface for walking thereon; and a roller secured to the sole, the roller disposed rearward of the forward region and extending below a lowermost extent of the heel region, the roller mounted to rotate about an axle defining a primary axis of rotation extending at an angle of between about zero and 45 degrees to the walking direction, as viewed from above the shoe, the axle secured to the sole through a compliant mount that allows tilting of the axle with respect to the sole to vary direction of travel while rolling upon the roller, the roller positioned so as to enable rolling sideways along a support surface as a mode of personal locomotion.

2. The shoe of claim 1 wherein the roller is removable.

3. The shoe of claim 1 wherein the roller is retractable.

4. The shoe of claim 1 wherein the sole is flexible for bending during walking.

5. The shoe of claim 1 wherein the roller forms a lowermost portion of the shoe.

6. The shoe of claim 1 wherein the axle is mountable to the sole in a plurality of selectable axis orientations.

7. The shoe of claim 6 wherein, in one of the axis orientations, the axle defines an alternate axis of rotation extending substantially perpendicular to the walking direction.

8. The shoe of claim 1 wherein the shoe comprises two such rollers.

9. The shoe of claim 8 wherein the two rollers are spaced apart laterally across the sole.

10. The shoe of claim 9 wherein centers of the two rollers have a lateral spacing of about 20 percent of an overall length of the sole.

11. The shoe of claim 8 wherein the two rollers are spaced apart along the walking direction.

12. The shoe of claim 11 wherein midplanes of the two rollers are spaced apart along the walking direction by a distance of about 30 percent of an overall length of the sole.

13. The shoe of claim 1 further comprising a grinding surface disposed between the rollers and defining a laterally extending channel for receiving a rail.

14. The shoe of claim 13 wherein the grinding surface comprises a circumferential surface of a rolling member.

15. The shoe of claim 13 wherein the grinding surface is rigidly secured to the sole of the shoe.

16. The shoe of claim 1 wherein the sole defines a cavity having an opening at the lower surface of the sole, the roller being partially disposed within the cavity and extending through the cavity opening.

17. The shoe of claim 16 wherein the roller axle is mounted to a support cup spanning the roller and disposed within the sole cavity.

18. The shoe of claim 17 wherein the support cup is removable from the sole cavity.

19. The shoe of claim 17 wherein the support cup, roller and axle are removable from the sole cavity as a unit.

20. The shoe of claim 17 wherein the support cup is selectively positionable in the cavity in a first position for rolling, in which the roller extends through the cavity opening, and a second position for walking, in which the roller is fully recessed within the cavity.

21. The shoe of claim 20 wherein the cup encloses the roller within the cavity in said second position for walking.

22. The shoe of claim 1 wherein the roller is elongated.

23. The shoe of claim 1 wherein the roller is barrel-shaped.

24. The shoe of claim 1 wherein the roller comprises a wheel.

25. The shoe of claim 1 wherein the roller contains a bearing supporting the roller on the axle.

26. The shoe of claim 25 wherein the bearing contains rolling elements.

27. The shoe of claim 1 wherein the roller is cylindrical.

28. The shoe of claim 1 wherein the roller is disposed in an arch region of the sole.

29. The shoe of claim 1 wherein the roller defines a rolling surface spanning a distance of at least 2.0 inches (5 centimeters) along the sole.

30. The shoe of claim 29 wherein the rolling surface spans a distance of at least about 2.5 inches (6.3 millimeters) along the sole.

31. The shoe of claim 29 wherein the rolling surface spans at least about 15 percent of an overall length of the shoe.

32. The shoe of claim 31 wherein the rolling surface spans at least about 20 percent of an overall length of the shoe.

33. The shoe of claim 32 wherein the rolling surface spans at least about 25 percent of an overall length of the shoe.

34. The shoe of claim 29 wherein the roller comprises multiple wheels mounted for rotation about a single axis.

35. The shoe of claim 1 wherein the axle defines a canted kingpin axis about which the axle rotates to induce yaw with respect to a rolling direction.

36. The shoe of claim 35 wherein the axle is secured to the sole through a compliant mount that resiliently deforms as the axle is rotated about its kingpin axis.

37. The shoe of claim 35 wherein the axle carries two rollers, one disposed on either side of the kingpin axis.

38. The shoe of claim 37 wherein the rollers are cylindrical.

39. The shoe of claim 37 wherein the rollers are mounted for rotation about the axle through separate bearings containing rolling elements.

40. The shoe of claim 37 wherein a fore-aft distance between midplanes of the rollers is about 3.0 inches (76 millimeters).

41. The shoe of claim 40 wherein the fore-aft distance between midplanes is about 30 percent of an overall length of the sole.

42. The shoe of claim 35 wherein the kingpin axis is defined in part by a pin of the axle disposed for rotation within a socket of axle mounting structure secured to the sole.

43. The shoe of claim 35 wherein the axle is disposed in an arch region of the sole, between the forward region and an exposed heel region of the sole.

44. The shoe of claim 35 wherein the axle is selectively removable from the sole for walking.

45. The shoe of claim 35 wherein the shoe further comprises a roller mounted to rotate about a fixed axle laterally spaced from the axle with the canted kingpin axis.

46. The shoe of claim 45 wherein the fixed axle is disposed on a side of the kingpin axis facing an inner side of the shoe.

47. The shoe of claim 35 comprising at least two rollers, each mounted for rotation about corresponding, independent axles, each axle defining a canted kingpin axis about which the axle rotates to induce yaw with respect to a rolling direction, the axles spaced apart laterally across the sole.

48. The shoe of claim 47 wherein each axle carries two rollers, one disposed on either side of its kingpin axis.

49. The shoe of claim 47 wherein the two rollers together define a wheelbase of about 20 percent of an overall length of the shoe.

50. The shoe of claim 47 wherein each kingpin axis extends upward toward an adjacent side of the shoe.

51. The shoe of claim 35 wherein both axles and their associated rollers are completely disposed within a shoe width defined by the exposed forward region of the sole.

52. The shoe of claim 1 wherein the roller defines at least two support surface contact points separated by at least 1.5 inches (38 millimeters).

53. The shoe of claim 52 wherein the contact points are defined on a single rolling member.

54. The shoe of claim 53 wherein the rolling member is shaped to engage a fiat, horizontal supporting surface at one of the contact points in a first roller tilt direction, and the other of the contact points in a second roller tilt direction.

55. The shoe of claim 53 wherein the rolling member is shaped to engage a flat, horizontal supporting surface at both contact points simultaneously.

56. The shoe of claim 52 wherein the contact points are defined on at least two independently rotatable rolling members.

57. The shoe of claim 1 wherein the roller, axle and compliant mount are secured to the sole as a removable assembly.

58. The shoe of claim 57 wherein the assembly is configured to be removed from the shoe sole in a manual, tool-free operation.

59. The shoe of claim 57 wherein the assembly is secured to the shoe sole by a removable pin extending through a hole defined in a mounting boss of the assembly.

60. A shoe defining a normal walking direction and comprising a sole defining a forward region positioned beneath toes and at least part of a ball of a foot received within the shoe and having a lower surface exposed across the forward region to engage a supporting surface for walking thereon; and a steerable truck assembly secured to the sole through a compliant mount and disposed rearward of the forward region, a roller mounted to the truck assembly to rotate about an axle defining a primary axis of rotation extending at an angle of between about zero and 45 degrees to the walking direction, as viewed from above the shoe, for rolling sideways along a support surface, arranged so as to enable personal locomotion.

61. The shoe of claim 60 wherein the sole is flexible for bending during walking.

62. The shoe of claim 60 wherein the axle is mountable to the sole in a plurality of selectable axis orientations.

63. The shoe of claim 62 wherein, in one of the axis orientations, the axle defines an alternate axis of rotation extending substantially perpendicular to the walking direction.

64. The shoe of claim 60 wherein the shoe comprises two such rollers.

65. The shoe of claim 64 wherein the two rollers are spaced apart laterally across the sole.

66. The shoe of claim 65 wherein centers of the two rollers have a lateral spacing of about 20 percent of an overall length of the sole.

67. The shoe of claim 64 wherein the two rollers are spaced apart along the walking direction.

68. The shoe of claim 67 wherein midplanes of the two rollers are spaced apart along the walking direction by a distance of about 30 percent of an overall length of the sole.

69. The shoe of claim 67 further comprising a grinding surface disposed between the rollers and defining a laterally extending channel for receiving a rail.

70. The shoe of claim 69 wherein the grinding surface comprises a circumferential surface of a rolling member.

71. The shoe of claim 69 wherein the grinding surface is rigidly secured to the sole of the shoe

72. The shoe of claim 60 wherein the sole defines a cavity having an opening at the lower surface of the sole, the roller being partially disposed within the cavity and extending through the cavity opening.

73. The shoe of claim 60 wherein the roller is elongated.

74. The shoe of claim 60 wherein the roller is barrel-shaped.

75. The shoe of claim 60 wherein the roller comprises a wheel.

76. The shoe of claim 60 wherein the roller contains a bearing supporting the roller on the axle.

77. The shoe of claim 76 wherein the bearing contains rolling elements.

78. The shoe of claim 60 wherein the roller is cylindrical.

79. The shoe of claim 60 wherein the axle defines a canted kingpin axis about which the axle rotates to induce yaw with respect to a rolling direction.

80. The shoe of claim 79 wherein the axle is secured to the sole through a compliant mount that resiliently deforms as the axle is rotated about its kingpin axis.

81. The shoe of claim 79 wherein the axle carries two rollers, one disposed on either side of the kingpin axis.

82. The shoe of claim 81 wherein the rollers are mounted for rotation about the axle through separate bearings containing rolling elements.

83. The shoe of claim 81 wherein a fore-aft distance between midplanes of the rollers is about 3.0 inches (76 millimeters).

84. The shoe of claim 83 wherein the fore-aft distance between midplanes is about 30 percent of an overall length of the sole.

85. The shoe of claim 79 wherein the kingpin axis is defined in part by a pin of the axle disposed for rotation within a socket of axle mounting structure secured to the sole.

86. The shoe of claim 79 wherein the axle is disposed in an arch region of the sole, between the forward region and an exposed heel region of the sole.

87. The shoe of claim 79 wherein the axle is selectively removable from the sole for walking.

88. The shoe of claim 79 wherein the shoe further comprises a roller mounted to rotate about a fixed axle laterally spaced from the axle with the canted kingpin axis.

89. The shoe of claim 88 wherein the fixed axle is disposed on a side of the kingpin axis facing an inner side of the shoe.

90. The shoe of claim 79 comprising at least two rollers, each mounted for rotation about corresponding, independent axles, each axle defining a canted kingpin axis about which the axle rotates to induce yaw with respect to a rolling direction, the axles spaced apart laterally across the sole.

91. The shoe of claim 90 wherein each axle carries two rollers, one disposed on either side of its kingpin axis.

92. The shoe of claim 90 wherein the two rollers together define a wheelbase of about 20 percent of an overall length of the shoe.

93. The shoe of claim 90 wherein each kingpin axis extends upward toward an adjacent side of the shoe.

94. The shoe of claim 60 wherein the roller defines at least two support surface contact points separated by at least 1.5 inches (38 millimeters).

95. The shoe of claim 94 wherein the contact points are defined on a single rolling member.

96. The shoe of claim 95 wherein the rolling member is shaped to engage a flat, horizontal supporting surface at one of the contact points in a first roller tilt direction, and the other of the contact points in a second roller tilt direction.

97. The shoe of claim 95 wherein the rolling member is shaped to engage a flat, horizontal supporting surface at both contact points simultaneously.

98. The shoe of claim 94 wherein the contact points are defined on at least two independently rotatable rolling members.

99. The shoe of claim 60 wherein the truck assembly is secured to the sole as a removable assembly.

100. The shoe of claim 99 wherein the removable assembly is configured to be removed from the shoe sole in a manual, tool-free operation.

101. The shoe of claim 99 wherein the removable assembly is secured to the shoe sole by a removable pin extending through a hole defined in a mounting boss of the assembly.

102. A shoe defining a normal walking direction and comprising a sole defining a heel region and a forward region, the forward region positioned beneath toes and at least part of a ball of a foot received within the shoe and having a lower surface exposed across the forward region to engage a supporting surface for walking thereon; and a roller secured to the sole, the roller disposed rearward of the forward region and extending below a lowermost extent of the heel region, the roller mounted to rotate about an axle defining a primary axis of rotation extending at an angle of between about zero and 45 degrees to the walking direction, as viewed from above the shoe, the axle defining a canted kingpin axis about which the axle rotates to induce yaw with respect to a rolling direction, the axle secured to the sole through a compliant mount that resiliently deforms as the axle is rotated about its kingpin axis, the roller positioned so as to enable rolling sideways along a support surface as a mode of personal locomotion.

103. The shoe of claim 102 wherein the roller is removable.

104. The shoe of claim 102 wherein the roller is retractable.

105. The shoe of claim 102 wherein the sole is flexible for bending during walking.

106. The shoe of claim 102 wherein the roller forms a lowermost portion of the shoe.

107. The shoe of claim 102 wherein the axle is mountable to the sole in a plurality of selectable axis orientations.

108. The shoe of claim 102 wherein the shoe comprises two such rollers.

109. The shoe of claim 108 wherein the two rollers are spaced apart laterally across the sole.

110. The shoe of claim 109 wherein centers of the two rollers have a lateral spacing of about 20 percent of an overall length of the sole.

111. The shoe of claim 108 wherein midplanes of the two rollers are spaced apart along the walking direction by a distance of about 30 percent of an overall length of the sole.

112. The shoe of claim 102 wherein the sole defines a cavity having an opening at the lower surface of the sole, the roller being partially disposed within the cavity and extending through the cavity opening.

113. The shoe of claim 102 wherein the roller is elongated.

114. The shoe of claim 102 wherein the roller is barrel-shaped.

115. The shoe of claim 102 wherein the roller comprises a wheel.

116. The shoe of claim 102 wherein the roller contains a bearing supporting the roller on the axle.

117. The shoe of claim 102 wherein the roller is cylindrical.

118. The shoe of claim 102 wherein the roller is disposed in an arch region of the sole.

119. The shoe of claim 102 wherein the axle is selectively removable from the sole for walking.

120. The shoe of claim 102 wherein the shoe further comprises a roller mounted to rotate about a fixed axle laterally spaced from the axle with the canted kingpin axis.

121. The shoe of claim 102 comprising at least two rollers, each mounted for rotation about corresponding, independent axles, each axle defining a canted kingpin axis about which the axle rotates to induce yaw with respect to a rolling direction, the axles spaced apart laterally across the sole.

122. The shoe of claim 102 wherein the roller defines a rolling surface spanning a distance of at least 2.0 inches (5 centimeters) along the sole.

123. The shoe of claim 122 wherein the rolling surface spans a distance of at least about 2.5 inches (6.3 millimeters) along the sole.

124. The shoe of claim 122 wherein the rolling surface spans at least about 15 percent of an overall length of the shoe.

125. The shoe of claim 102 wherein the axle carries two rollers, one disposed on either side of the kingpin axis.

126. The shoe of claim 125 wherein a fore-aft distance between midplanes of the rollers is about 3.0 inches (76 millimeters).

127. The shoe of claim 102 comprising at least two rollers, each mounted for rotation about corresponding, independent axles, each axle defining a canted kingpin axis about which the axle rotates to induce yaw with respect to a rolling direction, the axles spaced apart laterally across the sole.

128. The shoe of claim 127 wherein the two rollers together define a wheelbase of about 20 percent of an overall length of the shoe.

129. The shoe of claim 102 wherein both axles and their associated rollers are completely disposed within a shoe width defined by the exposed forward region of the sole.

130. The shoe of claim 102 wherein the roller defines at least two support surface contact points separated by at least 1.5 inches (38 millimeters).

131. The shoe of claim 102 wherein the roller, axle and compliant mount are secured to the sole as a removable assembly.

132. The shoe of claim 131 wherein the assembly is configured to be removed from the shoe sole in a manual, tool-free operation.

133. The shoe of claim 131 wherein the assembly is secured to the shoe sole by a removable pin extending through a hole defined in a mounting boss of the assembly.

* * * * *